US010329764B2

(12) United States Patent
Collins et al.

(10) Patent No.: US 10,329,764 B2
(45) Date of Patent: Jun. 25, 2019

(54) PREFABRICATED DEMISING AND END WALLS

(71) Applicant: INNOVATIVE BUILDING TECHNOLOGIES, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 15/507,666

(22) PCT Filed: Aug. 28, 2015

(86) PCT No.: PCT/US2015/047536
§ 371 (c)(1),
(2) Date: Feb. 28, 2017

(87) PCT Pub. No.: WO2016/033525
PCT Pub. Date: Mar. 3, 2016

(65) Prior Publication Data

US 2017/0306625 A1 Oct. 26, 2017

Related U.S. Application Data

(63) Continuation-in-part of application No. PCT/US2014/053616, filed on Aug. 30, 2014.

(51) Int. Cl.
*E04C 2/288* (2006.01)
*E04B 1/14* (2006.01)
(Continued)

(52) U.S. Cl.
CPC ..... *E04C 2/288* (2013.01); *E04B 1/14* (2013.01); *E04B 2/7403* (2013.01); *E04B 2/7448* (2013.01); *E04B 1/61* (2013.01)

(58) Field of Classification Search
CPC .... E04B 2001/742; E04B 1/6162; E04B 1/80; E04B 2/7448; E04B 2/7403; E04B 1/14;
(Continued)

(56) References Cited

U.S. PATENT DOCUMENTS 1,168,556 A 1/1916 Robinson et al.
1,876,528 A 9/1932 Walters
(Continued)

FOREIGN PATENT DOCUMENTS

AU 2005200682 B1 5/2005
AU 2012211472 A1 2/2014
(Continued)

OTHER PUBLICATIONS

US 8,701,371 B2, 04/2014, Collins et al. (withdrawn)
(Continued)

*Primary Examiner* — Adriana Figueroa
*Assistant Examiner* — Jessie T Fonseca

(57) ABSTRACT

An example apparatus is disclosed that may be a demising wall that may include two structurally insulated panels (SIPS). Each of the SIPS may be configured to span between a floor and a ceiling of a building unit, and the two SIPS are spaced apart to define an interstitial space between the SIPS, wherein each of the SIPS includes an interior surface having a magnesium oxide board and an exterior surface having a fiber cement board. An example method is disclosed for assembling a demising wall to a floor panel. An example apparatus is disclosed that may be an end wall panel that may include two SIPS. Each of the SIPS may be configured to span between a floor and a ceiling of a building unit. An example method is disclosed for assembling an end wall panel to a floor panel.

17 Claims, 11 Drawing Sheets

(51) Int. Cl.
*E04B 2/74* (2006.01)
*E04B 1/61* (2006.01)

(58) Field of Classification Search
CPC ... E04B 1/61; E04C 2/246; E04C 2/26; E04C 2/288; E04F 13/0875
See application file for complete search history.

(56) References Cited

U.S. PATENT DOCUMENTS 1,883,376 A 10/1932 Meier et al.
2,160,161 A 5/1939 Marsh
2,419,319 A 4/1947 Fletcher
2,495,862 A 1/1950 Osborn
2,562,050 A 7/1951 Fletcher
2,686,420 A 8/1954 Youtz
2,722,724 A 11/1955 Miller
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 Graham
3,053,509 A 9/1962 Haupt et al.
3,065,575 A 11/1962 Ray
3,079,652 A 3/1963 Wahlfeld
3,184,893 A 5/1965 Booth
3,221,454 A 12/1965 Togni
3,235,917 A 2/1966 Skubic
3,236,014 A 2/1966 Edgar
3,245,183 A 4/1966 Tessin, II
3,281,172 A 10/1966 Kuehl
3,315,424 A 4/1967 Smith
3,376,919 A 4/1968 Agostino
3,388,512 A 6/1968 Newman
3,392,497 A 7/1968 Cushman
3,411,252 A 11/1968 Boyle, Jr.
3,460,302 A 8/1969 Cooper
3,490,191 A 1/1970 Ekblom
3,579,935 A 5/1971 Regan et al.
3,590,393 A 7/1971 Hollander et al.
3,594,965 A 7/1971 Saether
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr et al.
3,742,666 A 7/1973 Antoniou
3,751,864 A 8/1973 Berger et al.
3,755,974 A 9/1973 Berman
3,762,115 A 10/1973 McCaul, III et al.
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,038,796 A 8/1977 Eckel
4,050,215 A 9/1977 Fisher
4,059,936 A 11/1977 Lukens
4,078,345 A 3/1978 Piazzalunga
4,107,886 A 8/1978 Ray et al.
4,112,173 A 9/1978 Roudebush et al.
4,142,255 A 3/1979 Togni
4,161,087 A 7/1979 Levesque
4,171,545 A 10/1979 Kann
4,176,504 A 12/1979 Huggins
4,178,343 A 12/1979 Rojo, Jr.
4,206,162 A 6/1980 Vanderklaauw
4,214,413 A 7/1980 Gonzalez Espinosa de Los Monteros
4,221,441 A 9/1980 Bain
4,226,061 A 10/1980 Day, Jr.
4,251,974 A 2/1981 Vanderklaauw
4,280,307 A 7/1981 Griffin
4,314,430 A 2/1982 Farrington
4,325,205 A 4/1982 Salim et al.
4,327,529 A 5/1982 Bigelow, Jr. et al.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu et al.
4,441,286 A 4/1984 Skvaril
4,447,987 A 5/1984 Lesosky
4,447,996 A 5/1984 Maurer, Jr. et al.
4,477,934 A 10/1984 Salminen
4,507,901 A 4/1985 Carroll
4,513,545 A 4/1985 Hopkins, Jr.
4,528,793 A 7/1985 Johnson
4,646,495 A 3/1987 Chalik
4,648,228 A * 3/1987 Kiselewski ..... E04B 1/161 52/426
4,655,011 A 4/1987 Borges
4,688,750 A 8/1987 Teague et al.
4,712,352 A * 12/1987 Low ..... E04C 2/521 52/220.2
4,757,663 A 7/1988 Kuhr
4,856,244 A 8/1989 Clapp
4,862,663 A 9/1989 Krieger
4,893,435 A 1/1990 Shalit
4,918,897 A 4/1990 Luedtke
4,919,164 A 4/1990 Barenburg
4,974,366 A 12/1990 Tizzoni
4,991,368 A 2/1991 Amstutz
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,154,029 A 10/1992 Sturgeon
5,185,971 A 2/1993 Johnson, Jr.
5,205,091 A 4/1993 Brown
5,212,921 A 5/1993 Unruh
5,233,810 A 8/1993 Jennings
5,307,600 A 5/1994 Simon, Jr. et al.
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,459,966 A 10/1995 Suarez et al.
5,471,804 A 12/1995 Winter, IV
5,493,838 A 2/1996 Ross
5,509,242 A 4/1996 Rechsteiner et al.
5,519,971 A 5/1996 Ramirez
5,528,877 A 6/1996 Franklin
5,584,142 A 12/1996 Spiess
5,592,796 A 1/1997 Landers
5,611,173 A 3/1997 Headrick et al.
5,628,158 A 5/1997 Porter
5,640,824 A 6/1997 Johnson et al.
5,660,017 A 8/1997 Houghton
5,678,384 A 10/1997 Maze
5,697,189 A 12/1997 Miller et al.
5,699,643 A 12/1997 Kinard
5,706,607 A 1/1998 Frey
5,724,773 A 3/1998 Hall
5,746,034 A 5/1998 Luchetti et al.
5,755,982 A 5/1998 Strickland et al.
5,850,686 A 12/1998 Mertes
5,867,964 A 2/1999 Perrin
5,870,867 A 2/1999 Mitchell
5,921,041 A 7/1999 Egri, II
5,987,841 A 11/1999 Campo

(56) References Cited

U.S. PATENT DOCUMENTS 5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot et al.
6,086,350 A 7/2000 Del Monte
6,154,774 A 11/2000 Furlong et al.
6,170,214 B1 1/2001 Treister et al.
6,240,704 B1 * 6/2001 Porter ..... E04C 2/246 52/309.14
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt et al.
6,371,188 B1 4/2002 Baczuk et al.
6,393,774 B1 5/2002 Fisher
6,430,883 B1 8/2002 Paz et al.
6,446,396 B1 9/2002 Marangoni et al.
6,481,172 B1 11/2002 Porter
6,484,460 B2 11/2002 VanHaitsma
6,625,937 B1 9/2003 Parker et al.
6,651,393 B2 11/2003 Don et al.
6,729,094 B1 5/2004 Spencer et al.
6,748,709 B1 6/2004 Sherman et al.
6,837,013 B2 1/2005 Foderberg et al.
6,922,960 B2 8/2005 Sataka
7,007,343 B2 3/2006 Weiland et al.
7,059,017 B1 6/2006 Rosko et al.
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Levy
7,484,339 B2 2/2009 Fiehler
7,493,729 B1 2/2009 Semmes
7,574,837 B2 8/2009 Hagen, Jr. et al.
7,658,045 B2 2/2010 Elliott et al.
7,676,998 B2 3/2010 Lessard
7,694,462 B2 4/2010 O'Callaghan et al.
7,721,491 B2 5/2010 Appel
7,748,193 B2 7/2010 Knigge et al.
7,908,810 B2 3/2011 Payne, Jr. et al.
7,921,965 B1 4/2011 Surace
7,966,778 B2 6/2011 Klein
8,051,623 B2 11/2011 Loyd
8,096,084 B2 1/2012 Studebaker et al.
8,109,058 B2 2/2012 Miller
8,166,716 B2 5/2012 Macdonald et al.
8,234,827 B1 8/2012 Schroeder, Sr. et al.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner et al.
8,505,259 B1 8/2013 Degtyarev
8,539,732 B2 9/2013 Leahy
8,555,581 B2 10/2013 Amend
8,555,589 B2 10/2013 Semmens et al.
8,621,806 B2 1/2014 Studebaker et al.
8,733,046 B2 5/2014 Naidoo
8,769,891 B2 7/2014 Kelly
8,833,025 B2 9/2014 Krause
8,950,132 B2 2/2015 Collins et al.
8,966,845 B1 3/2015 Ciuperca
8,978,324 B2 3/2015 Collins et al.
8,997,424 B1 4/2015 Miller
9,027,307 B2 5/2015 Collins et al.
9,382,709 B2 7/2016 Collins et al.
2002/0059763 A1 5/2002 Wong
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0200706 A1 10/2003 Kahan et al.
2003/0221381 A1 12/2003 Ting
2004/0065036 A1 4/2004 Capozzo
2004/0103596 A1 6/2004 Don et al.
2005/0081484 A1 4/2005 Yland et al.
2005/0108957 A1 5/2005 Quesada
2005/0188632 A1 9/2005 Rosen
2005/0198919 A1 9/2005 Hester
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.
2005/0235581 A1 10/2005 Cohen et al.
2005/0262771 A1 12/2005 Gorman
2006/0021289 A1 2/2006 Elmer
2006/0070321 A1 4/2006 Au
2006/0096202 A1 5/2006 DelZotto
2006/0117689 A1 6/2006 Onken et al.
2006/0137293 A1 6/2006 Klein
2006/0143856 A1 7/2006 Rosko et al.
2006/0150521 A1 7/2006 Henry et al.
2006/0179764 A1 8/2006 Ito
2006/0248825 A1 11/2006 Garringer
2007/0000198 A1 1/2007 Payne, Jr. et al.
2007/0074464 A1 4/2007 Eldridge et al.
2007/0107349 A1 5/2007 Erker
2007/0163197 A1 7/2007 Payne et al.
2007/0209306 A1 9/2007 Andrews et al.
2007/0234657 A1 10/2007 Speyer et al.
2007/0283640 A1 12/2007 Shivak et al.
2007/0294954 A1 12/2007 Barrett et al.
2008/0000177 A1 1/2008 Siu
2008/0057290 A1 3/2008 Guevara et al.
2008/0098676 A1 5/2008 Hutchens
2008/0104901 A1 5/2008 Olvera
2008/0168741 A1 7/2008 Gilgan et al.
2008/0178542 A1 7/2008 Williams
2008/0202048 A1 8/2008 Miller et al.
2008/0222981 A1 9/2008 De Gobbi
2008/0229669 A1 9/2008 Abdollahzadeh et al.
2008/0282626 A1 11/2008 Powers, Jr.
2008/0295450 A1 12/2008 Yogev
2009/0031652 A1 2/2009 Ortega Gatalan
2009/0038764 A1 2/2009 Pilz
2009/0077916 A1 3/2009 Scuderi et al.
2009/0090074 A1 4/2009 Klein
2009/0100760 A1 4/2009 Ewing
2009/0100769 A1 4/2009 Barrett et al.
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0293395 A1 12/2009 Porter
2009/0313931 A1 12/2009 Porter
2010/0064590 A1 3/2010 Jones et al.
2010/0064601 A1 3/2010 Napier
2010/0146874 A1 6/2010 Brown
2010/0186313 A1 7/2010 Stanford et al.
2010/0212255 A1 8/2010 Lesoine
2010/0218443 A1 9/2010 Studebaker et al.
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0325989 A1 12/2010 Leahy

(56) References Cited

U.S. PATENT DOCUMENTS

| | | | |
|---|---|---|---|
| 2011/0041411 | A1 | 2/2011 | Aragon |
| 2011/0056147 | A1 | 3/2011 | Beaudet |
| 2011/0113709 | A1 | 5/2011 | Pilz et al. |
| 2011/0154766 | A1 | 6/2011 | Kralic et al. |
| 2011/0162167 | A1 | 7/2011 | Blais |
| 2011/0219720 | A1 | 9/2011 | Strickland et al. |
| 2011/0247281 | A1* | 10/2011 | Pilz ..... E04B 2/7411 52/173.1 |
| 2011/0268916 | A1 | 11/2011 | Pardue, Jr. |
| 2011/0296769 | A1 | 12/2011 | Collins et al. |
| 2011/0296778 | A1 | 12/2011 | Collins et al. |
| 2011/0300386 | A1 | 12/2011 | Pardue, Jr. |
| 2012/0151869 | A1 | 6/2012 | Miller |
| 2012/0167505 | A1 | 7/2012 | Krause |
| 2012/0186174 | A1 | 7/2012 | LeBlang |
| 2012/0210658 | A1 | 8/2012 | Logan |
| 2012/0297712 | A1 | 11/2012 | Lutzner et al. |
| 2012/0317923 | A1 | 12/2012 | Herdt et al. |
| 2013/0025222 | A1 | 1/2013 | Mueller |
| 2013/0036688 | A1 | 2/2013 | Gosain |
| 2013/0067832 | A1 | 3/2013 | Collins et al. |
| 2013/0111840 | A1 | 5/2013 | Bordener |
| 2013/0133277 | A1 | 5/2013 | Lewis |
| 2014/0013678 | A1 | 1/2014 | Deverini |
| 2014/0013695 | A1 | 1/2014 | Wolynski et al. |
| 2014/0047780 | A1 | 2/2014 | Quinn et al. |
| 2014/0059960 | A1 | 3/2014 | Cole |
| 2014/0069040 | A1 | 3/2014 | Gibson |
| 2014/0069050 | A1 | 3/2014 | Bolin |
| 2014/0083046 | A1 | 3/2014 | Yang |
| 2014/0090323 | A1 | 4/2014 | Glancy |
| 2014/0130441 | A1 | 5/2014 | Sugihara et al. |
| 2015/0096251 | A1 | 4/2015 | McCandless et al. |
| 2016/0290030 | A1 | 10/2016 | Collins et al. |
| 2017/0306624 | A1 | 10/2017 | Graham et al. |
| 2018/0038103 | A1 | 2/2018 | Neumayr |

FOREIGN PATENT DOCUMENTS

| | | | |
|---|---|---|---|
| CN | 201037279 | Y | 3/2008 |
| CN | 101821462 | | 9/2010 |
| CN | 101831963 | | 9/2010 |
| CN | 102459775 | | 5/2012 |
| CN | 102587693 | A | 7/2012 |
| CN | 202391078 | | 8/2012 |
| CN | 102733511 | A | 10/2012 |
| DE | 4205812 | | 9/1993 |
| DE | 20315506 | | 11/2004 |
| EP | 1045078 | A2 | 10/2000 |
| EP | 1375804 | A2 | 1/2004 |
| EP | 2128353 | A1 | 12/2009 |
| EP | 2213808 | | 8/2010 |
| EP | 2238872 | A2 | 10/2010 |
| EP | 1739246 | B1 | 1/2011 |
| EP | 2281964 | A1 | 2/2011 |
| FR | 1317681 | | 5/1963 |
| FR | 2988749 | A1 | 10/2013 |
| GB | 898905 | A | 6/1962 |
| JP | S5215934 | Y2 | 4/1977 |
| JP | S53000014 | Y2 | 1/1978 |
| JP | S5484112 | U | 6/1979 |
| JP | S57158451 | A | 9/1982 |
| JP | H0310985 | A | 1/1991 |
| JP | H049373 | Y2 | 3/1992 |
| JP | H0752887 | Y2 | 12/1995 |
| JP | 2576409 | B2 | 1/1997 |
| JP | 10234493 | A | 9/1998 |
| JP | H10245918 | A | 9/1998 |
| JP | 2000144997 | A | 5/2000 |
| JP | 3137760 | B2 | 2/2001 |
| JP | 2002536615 | | 10/2002 |
| JP | 2002364104 | A | 12/2002 |
| JP | 2008073434 | A | 4/2008 |
| JP | 2008110104 | A | 5/2008 |
| KR | 19990052255 | | 7/1999 |
| KR | 19990053902 | | 7/1999 |
| KR | 100236196 | | 12/1999 |
| KR | 200200413 | | 10/2000 |
| KR | 20060066931 | A | 6/2006 |
| WO | 9107557 | A1 | 5/1991 |
| WO | 9722770 | A1 | 6/1997 |
| WO | 235029 | A1 | 5/2000 |
| WO | 2000046457 | | 8/2000 |
| WO | 0058583 | A1 | 10/2000 |
| WO | 2007059003 | A2 | 5/2007 |
| WO | 2010030060 | A1 | 3/2010 |
| WO | 2010037938 | A2 | 4/2010 |
| WO | 2016032537 | A1 | 3/2016 |
| WO | 2016032538 | A1 | 3/2016 |
| WO | 2016032539 | A1 | 3/2016 |
| WO | 2016032540 | A1 | 3/2016 |
| WO | 2016033429 | A1 | 3/2016 |
| WO | 2016033525 | A1 | 3/2016 |

OTHER PUBLICATIONS

"Beam to column connection," TATA Steel, accessed at https://web.archive.org/web/20140706075634/http://www.tatasteelconstruction.com/en/reference/teaching_resources/architectural_studio_reference/elements/connections/beam_to_column_connections, accessed on Mar. 1, 2017, pp. 3.

"Emerging Trends in real estate," Urban Land Institute, accessed at https://web.archive.org/web/20140813084823/http://pwc.com.au/industry/real-estate/assets/Real-Estate-2012-Europe-Jan12.pdf, pp. 60 (2012).

"FC EW 1-12mm Fibre Cement Sheet+ 9mm MgO Board Wall Assembly", FRAMECAD, pp. 2 (2013).

"How to Soundproof a Ceiling—Soundproofing Ceilings," accessed at https://web.archive.org/web/20140829130523/http://www.soundproofingcompany.com/soundproofing-solutions/soundproof-a-ceiling, accessed on Mar. 1, 2017, pp. 7.

"Structural Insulated Panel;" Wikipedia, accessed at https://web.archive.org/web/20131207165431/http://en.wikipedia.org/wiki/Structural_insulated_panel, last modified on Nov. 20, 2013, pp. 3.

"Structural Insulated Panels," Whole Building Design Guide, accessed at https://web.archive.org/web/20140828133136/http://www.wbdg.org/resources/sips.php, accessed on Mar. 1, 2017, pp. 8.

Azari, R., et al., "Modular Prefabricated Residential Construction—Constraints and Opportunities", PNCCRE Technical Report #TR002, pp. 90 (Aug. 2013).

Borzouie, J., and Mahdizadeh, A., "Seismic Assessment and Rehabilitation of Diaphragms—Technical report," pp. 1-86 (2011).

European Search Report for Patent Application No. 14891125.8, dated Jul. 8, 2016, pp. 4.

Giles, H. and Lara, F., "Innovations in the Development of Industrially Designed and Manufactured Modular Concepts for Low-Energy, Multi-story, High-Density, Prefabricated Affordable Housing," accessed at http://sitemaker.umich.edu/path-nsf giles/files/giles_and_lara_final.pdf, accessed on Jun. 16, 2015, pp. 1-15.

Gonchar, J., "Paradigm Shift," accessed at https://web.archive.org/web/20130326154444/http://continuingeducation.construction.com/article.php?L=5&C=943&P=2, Posted on Oct. 2012, pp. 2.

Insulspan Installation Guide, Installation Guide, pp. 58 (Apr. 25, 2008).

International Search Report and Written opinion for International Application No. PCT/US/2014/053613 dated Dec. 18, 2014, pp. 13.

International Search Report and Written opinion for International Application No. PCT/US/2014/053614 dated Dec. 18, 2014, pp. 11.

International Search Report and Written opinion for International Application No. PCT/US/2014/053615 dated Dec. 17, 2014, pp. 11.

International Search Report and Written opinion for International Application No. PCT/US/2014/053616 dated Dec. 17, 2014, pp. 9.

International Search Report and Written opinion for International Application No. PCT/US15/47536 dated Dec. 4, 2015, pp. 17.

International Search Report and Written Opinion for International Application No. PCT/US2011/001039 dated Oct. 5, 2011, pp. 14.

(56) References Cited

OTHER PUBLICATIONS

International Search Report and Written opinion for International Application No. PCT/US2015/047383 dated Jan. 12, 2016, pp. 14.
Kerin, J. and Nadji , H., "National Apartment Report—2013",pp. 1-62 (2013).
McIlwain, J., "Housing in America—The Next Decade," Urban Land Institute, pp. 36 (2010).
McIlwain, J., "The Rental Boost From Green Design," Urban Land, accessed at http://urbanland.uli.org/sustainability/the-rental-boost-from-green-design/, Jan. 4, 2012, pp. 7.
Riusillo, M.A., "Lift Slab Construction: Its History, Methodology, Economics, and Applications," International Concrete Abstracts Portal, Special Publication, vol. 107, pp. 59-68 (Jun. 1, 1988).
"Shashaty, A., "Housing Demand," Sustainable Communities, pp. 3 (Mar./Apr. 2011)".
Sichelman, L., "NAHB/Orlando: Severe Apartment Shortage Looms," accessed at http://urbanland.uli.org/capital-markets/nahb-orlando-severe-apartment-shortage-looms/, Urban Land, Jan. 13, 2011, pp. 2.
Stiemer, S F., "Bolted Beam-Column Connections (Design and Cost Estimation);" Steel Design, pp. 1-16 (Nov. 11, 2007).
Extended European Search Report for European Patent Application No. 14900469 dated Mar. 20, 2018, pp. 8.
Non-Final Office Action in U.S. Appl. No. 15/507,654 dated Apr. 11, 2018, 67 pages.

* cited by examiner

PREFABRICATED DEMISING AND END WALLS

CROSS-REFERENCE TO RELATED APPLICATIONS

This application is a U.S. national stage filing under 35 U.S.C. § 371 of International Application No. PCT/US2015/047536, filed on Aug. 28, 2015 and entitled "Prefabricated Demising and End Walls", which claims priority under 35 U.S.C. § 120 as a continuation-in-part of International Application No. PCT/US2014/053616, filed on Aug. 30, 2014 and entitled "Prefabricated Demising and End Walls", the disclosure of which is incorporated by reference in its entirety.

BACKGROUND

Building design and construction is the last large industry in the world where the products (office buildings, shopping malls, apartments, etc.) are built by hand. The people who design the buildings (architects and engineers) are typically separate from the people who construct the buildings (contractors) for liability reasons. Architects do not want the liability of how the building is built, and conversely, contractors do not want the liability of how the building is drawn and engineered. Furthermore, buildings are constructed by people with specific trade skills, deployed in a linear sequence and buildings are typically built by hand outside in the elements. Therefore, conventional construction is more of a process than a product, resulting in a great deal of waste and inefficiency.

The industry's response to improving efficiency has historically been modular construction. In the case of multi-housing (apartments, hotels, student dorms, etc.), entire units are built off-site in a factory and the modules are trucked to the job site. The modules are then stacked and connected. The modules are wood frame, using trades and built by hand similar to conventional in-field construction. They are used in low-rise construction (1-6 stories). This method of construction has been around for several decades, and there are a number of companies in this space.

In contrast, some building technology may utilize prefabricated components instead of prefabricated modules. The components comprise a "kit of parts", and the parts may be prefabricated independent of one another and trucked to the job site for installation and connection.

SUMMARY

Techniques are generally described that include apparatuses, methods, and systems. An example apparatus may be a wall including a first structurally insulated panel (SIP), a second SIP opposite the first SIP, and a first hat channel coupled between the first SIP and the second SIP along a first edge of the wall.

In some embodiments, the first hat channel is configured to nest with a first sister hat channel coupled to a floor.

In some embodiments, the wall may further include a second hat channel coupled between the first SIP and the second SIP along a second edge of the wall, the second edge opposite the first edge. In some embodiments, the second hat channel is configured to nest with a second sister hat channel coupled to a ceiling. In some embodiments, a gap is formed between the second hat channel and the second sister hat channel. In some embodiments, the second hat channel is deeper than the first hat channel.

In some embodiments, each of the first and second SIP include a foam core, a magnesium oxide board coupled to a first surface of the foam core, and a fiber cement board coupled to a second surface of the foam core, the second surface opposite the first surface. In some embodiments, a finishing panel is coupled to the magnesium oxide board. In some embodiments, the finishing panel is coupled to the magnesium oxide board by a cleat.

In some embodiments, the first and second SIPS are coupled to the first hat channel such that the fiber cement board of the first SIP and the fiber cement board of the second SIP are proximate each other.

In some embodiments, the foam core of the first SIP is thicker than the foam core of the second SIP.

In some embodiments, a weather resistive barrier is coupled to the magnesium oxide board of the first SIP. In some embodiments, a vertical furring channel is coupled to the first SIP over the weather resistive barrier. In some embodiments, a cladding panel is coupled to the vertical furring channel.

In some embodiments, the wall includes a sprinkler pipe between the first SIP and second SIP.

In some embodiments, the first SIP and second SIP are further coupled by a horizontal furring channel.

An example method may include placing a wall having a first hat channel over a second hat channel coupled to a floor such that the first hat channel nests with the second hat channel, and placing the wall having a third hat channel over a fourth hat channel coupled to a ceiling such that the third hat channel nests with the fourth hat channel.

In some embodiments, the method may further include coupling the second hat channel to the floor, and coupling the fourth hat channel to the ceiling.

In some embodiments, the method may further include coupling the first and second hat channels with a fastener.

In some embodiments, the method may further include applying a fire sealant between the wall and the floor In some embodiments, The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
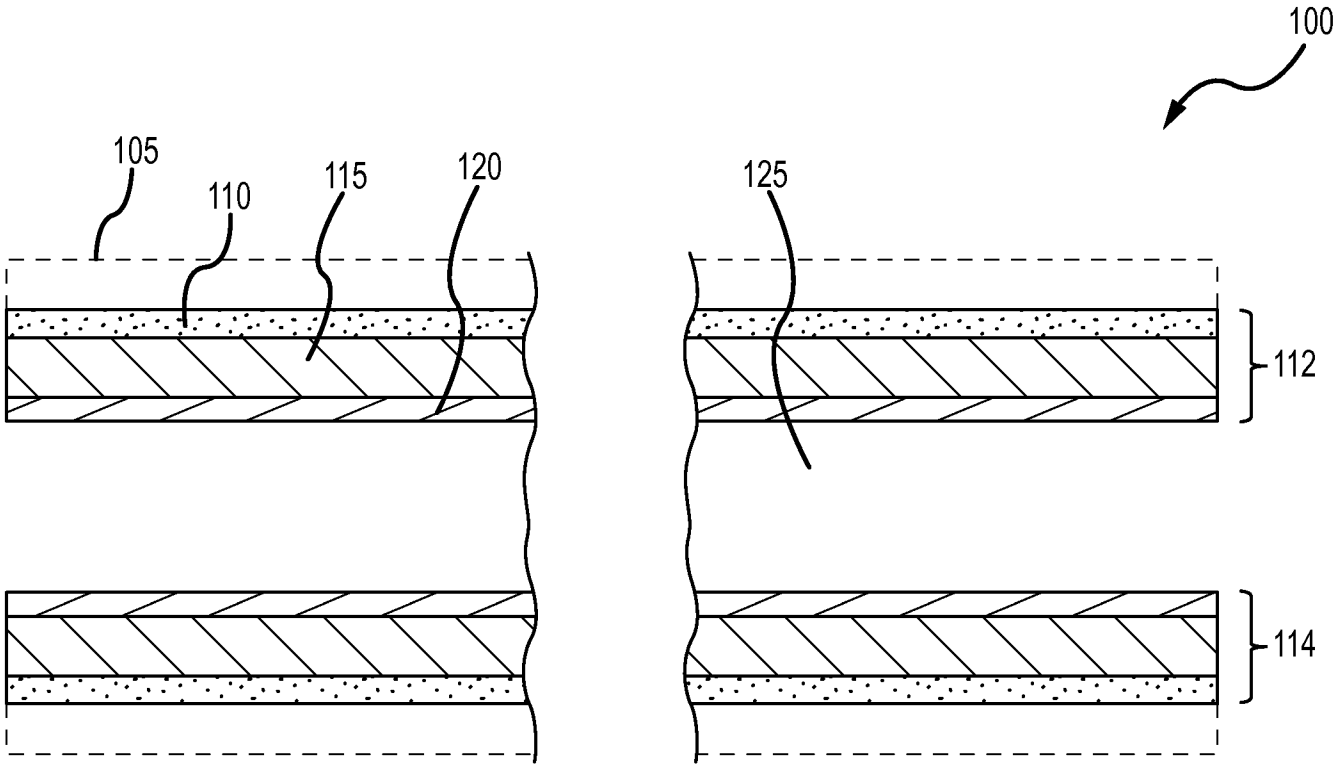
FIG. 1 is a schematic illustration of an embodiment of a demising wall.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatuses generally related to a wall comprising a first structurally insulated panel (SIP), a second SIP opposite the first SIP, and a first hat channel coupled between the first SIP and the second SIP along a first edge of the wall.

A demising wall may be a wall that at least partially separates two interior spaces in the building. For example, a demising wall may be used to define one or more rooms in the building. In some embodiments, the demising wall is non-load bearing. An end wall panel may be a wall that at least partially provides an exterior surface of a building. For example, an end wall may be used to define an exterior wall at an edge of a floor of a building. In some embodiments, the end wall panel is non-load bearing.

Demising and end wall panels may be fully integrated sub-assemblies that include 9'×22' structurally insulated panels (each with non-combustible fiber cement boards glued to an expanded polystyrene foam plastic core—called structural insulated panels (SIPS)). Demising and end walls may each include two 9'×22' SIPS panels connected at the top and bottom with furring or "hat" channels. Assembly of these materials in this manner may create an interstitial space for distribution of plumbing, electrical, duct work, and/or other systems to service a building's residential and/or commercial units.

The exterior of the end wall panel may include a weather-resistive barrier and/or a cladding panel system attached to the 4⅞" SIPS panel. The interior of the end wall panel may contain a series of finish panels attached to a 2" SIPS panel.

The demising wall may include two 2" SIPS panels, each with interior finishes on the outside and an interstitial space on the inside where the electrical, data/communications cabling, fire sprinkler pipe and insulation may run.

The demising and end wall panels may be sub-assemblies that may solve and/or alleviate the following problems in mid-rise and high rise residential projects: (a) costly and time consuming in-field construction of end walls of a building and demising (or separation) walls between units; (b) providing acoustical separation between units; (c) waterproofing, energy and thermal separation from the outside; and (d) providing interior finishes for a portion of the living space. The demising and end wall panels may meet and/or contribute to meeting: fire protection and codes; acoustical rating for ambient noise transfer; energy rating; tolerances for connecting to other wall panels; thermal and moisture protection. It is to be understood that not all embodiments may solve and/or alleviate all, or even any, of the above-described problems, and the problems are provided to facilitate appreciation of aspects of some embodiments described herein.

Demising and end wall sub-assemblies may be prefabricated off-site in a factory/shop and transported to the project jobsite for (a) attachment to a floor/ceiling system; (b) connection to window and utility walls; and/or (c) hook-up to building utilities. Demising and end wall panels are installed horizontally may rest on the topping slab poured in the field over the floor and ceiling panels. The demising wall may be designed to achieve a one hour fire rating required by the building code, and the end wall a two hour fire rating.

In some embodiments, the material composition of the demising and end wall panels may be predominantly polymers. In some embodiments, the material composition of the demising and end wall panels may be predominantly steel. In some embodiments it may be predominately aluminum. In still other embodiments, the demising and end wall panel components may be made from a variety of building suitable materials ranging from metals and/or metal alloys, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the demising and end wall panels and other building materials for other elements of the demising and end wall panels. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the demising and end wall panels described herein. Availability of various building materials in different parts of the world may also affect selection of materials for building the system described herein. Adoption of the International Building Code or similar code may also affect choice of materials.

Any reference herein to "metal" includes any construction grade metals or metal alloys as may be suitable for fabrication and/or construction of the demising and end wall panels and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

Turning now to the drawings, FIG. 1 is a schematic illustration of an embodiment of a demising wall 100. FIG. 1 shows a schematic illustration of a top-down view of an example demising wall 100 arranged in accordance with at least some embodiments described herein. FIG. 1 shows two structurally insulated panels (SIPS) 112, 114 arranged parallel to each other. Each SIP 112, 114 may include a magnesium oxide board 110, which may be coupled to a foam core 115, which may be coupled to a cement board 120. The SIPS 112, 114 may be configured so that the cement boards 120 are opposite one another and separated by an air space 125, forming a portion of an interior of the demising wall 100. Each SIP 112, 114 may be coupled to a finish wall panel 105 that may be coupled to the magnesium oxide boards 110. The various components described in FIG. 1 are merely embodiments, and other variations, including eliminating components, combining components, and substituting components are all contemplated.

The SIPS 112, 114 may be coupled to each other by hat channels (not shown in FIG. 1), as will be described in more detail below. The SIPS 112, 114 may both span a distance between a floor and a ceiling of a building unit. There may not be any studs—including any metal studs—between the SIPS 112, 114. In this manner, the demising wall 100 may provide a stud-free interior wall implementation In some embodiments, the magnesium oxide board 110 is 12 mm (15⁄32") thick. In some embodiments, the foam core 115 is a 25.4 mm (1") thick polystyrene expanded foam plastic core. In some embodiments, the cement board 120 is 11 mm (7⁄16") thick. In some embodiments, the air space 125 is 76 mm (3") wide. Other thicknesses for the foam core 115, boards 110, 120, and/or air space (e.g., interstitial space) 125 may be used. Different thicknesses and materials may be chosen based on the environmental requirements of the structure. In some embodiments, the magnesium oxide board 110 and fiber cement board 120 may completely cover opposite surfaces of the foam core 115. In some embodiments, the magnesium oxide board 110 and/or fiber cement board 120 may be implemented with plywood. In some embodiments, the magnesium oxide board 110 and/or fiber cement board 120 may be implemented with light-weight pre-cast concrete. Any other suitable construction material may be used in some embodiments. In some embodiments one or more of the boards 110, 120 may extend beyond one or more edges of the foam core 115. In some embodiments, the foam core 115 may extend beyond one or both boards 110, 120 along one or more edges.

The finish wall panel 105 may be paint applied to the magnesium oxide board 110 in some embodiments. In some embodiments, the finish wall panel 105 may be one or more decorative panels coupled to the magnesium oxide board 110. The one or more decorative panels may be implemented with glass panes, plastic, wood veneer, and/or other desired interior finish. The finish wall panel 105 may provide a portion of an interior finish of a wall of a room of a building unit (e.g., office, living room, bedroom).

Figure 2:
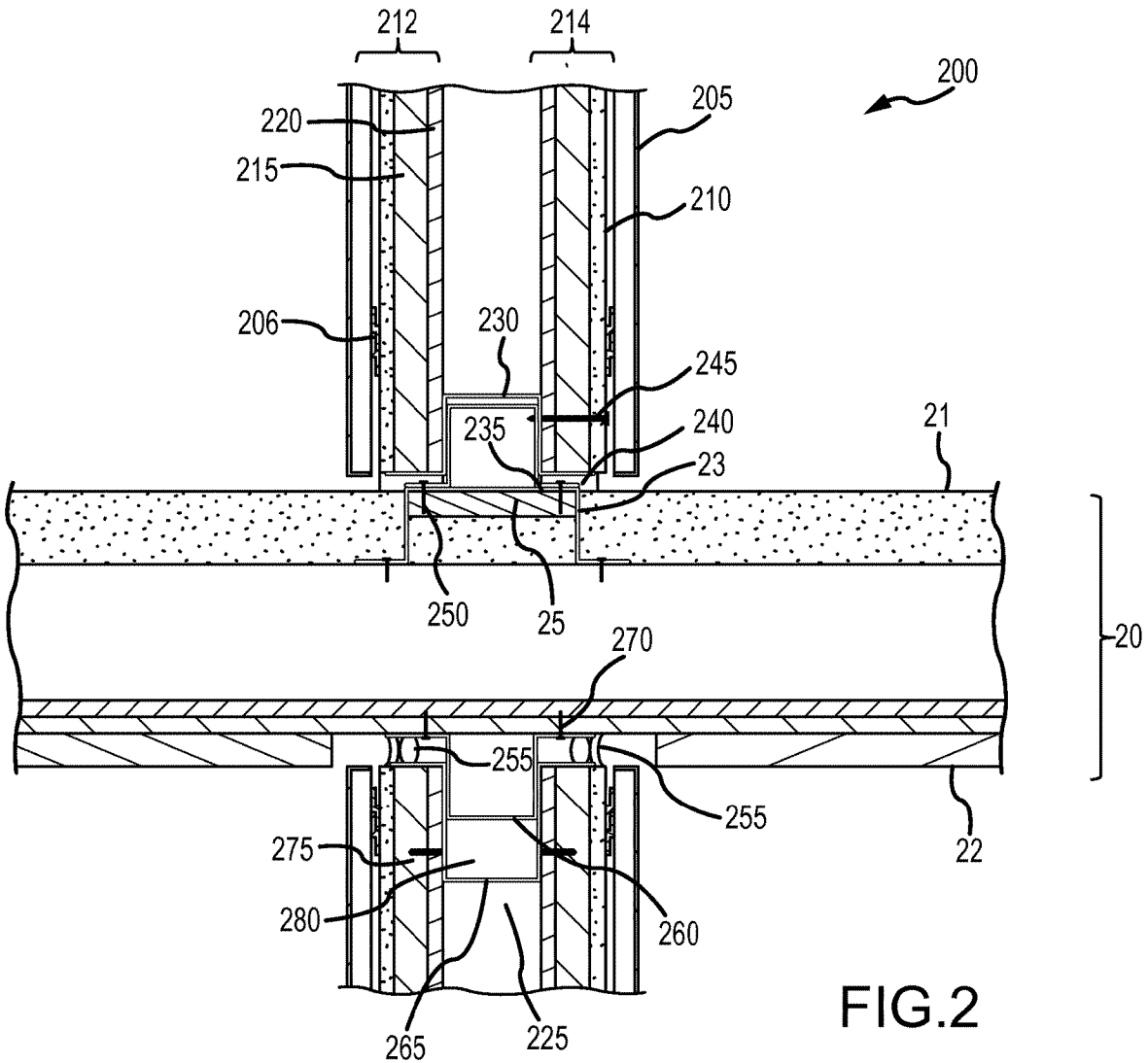
FIG. 2 is a schematic illustration of an embodiment of a demising wall interfacing with an embodiment of a floor and ceiling panel.

FIG. 2 is a schematic illustration of an embodiment of a demising wall 200 interfacing with an embodiment of a floor and ceiling panel 20. FIG. 2 shows a schematic illustration of a side view of an example demising wall 200 arranged in accordance with at least some embodiments described herein. FIG. 2 shows two SIPS 212, 214 of the demising wall 200 coupled to a first hat channel 230. The two SIPS 212, 214 may be coupled to a second hat channel 265. In some embodiments, the second hat channel 265 may be coupled to the SIPS 212, 214 by fasteners 275. The fasteners 275 may be implemented with screws, bolts, nails, other suitable fasteners, or a combination thereof. The first and second hat channels 230, 265 may be coupled to opposite ends of the demising wall 200. The various components described in FIG. 2 are merely embodiments, and other variations, including eliminating components, combining components, and substituting components are all contemplated.

In some embodiments, the demising wall 200 may interface with a floor and ceiling panel 20 as shown in FIG. 2. The first hat channel 230 may be along an edge of the demising wall 200 that couples to a floor 21 of a floor and ceiling panel 20. The first hat channel 230 included in the demising wall 200 may nest with a first sister hat channel 235 coupled to the floor 21. The second hat channel 265 may be along an edge of the demising wall 200 that couples to a ceiling 22 of the floor and ceiling panel 20. The second hat channel 265 may next with a second sister hat channel 260 coupled to the ceiling 22. By nesting, it is meant that the dimensions of the hat channels 230, 265 are such that the interiors of the hat channels 230, 265 fit around the exteriors of the sister hat channels 235, 260.

In some embodiments, the first sister hat channel 235 may be coupled to the floor 20. In some embodiments, the floor 21 may have a concrete surface. In some embodiments, the floor 20 may have a wood surface. In some embodiments, the sister hat channel 235 may be nailed, screwed, or bolted to the floor 21. The floor 21 may already have fasteners, such as bolts and/or screws, installed in the floor 21. As shown in FIG. 2, in some embodiments, a hat channel 23 including a foam strip 25 may be embedded in the concrete of the floor 21. The first sister hat channel 235 may be coupled to the hat channel 23 by embedding fasteners 250 through the hat channel 23 into the foam strip 25. In some embodiments, once the first hat channel 230 is nested with the first sister hat channel 235, the hat channels 230, 235 are coupled by a fastener 245. The fastener may pass through at least one of the SIPS 212, 214. The fastener 245 may be implemented with a screw, a bolt, a nail, or other suitable fastener. In some embodiments, a compressible fire sealant 240 may be between the floor 21 and the SIPS 212, 214.

In some embodiments, the second sister hat channel 260 may be coupled to a surface of the ceiling 22 by fasteners 270. The fasteners 270 may be implemented with screws, bolts, nails, other suitable fasteners, or a combination thereof. In some embodiments, fire caulk 255 may be between the ceiling 22 and SIPS 212, 214. As shown in FIG. 2, in some embodiments, the second hat channel 265 may be deeper than the second sister hat channel 260. In this manner, a gap 280 may be defined between the two hat channels 260, 265. The two hat channels 260, 265 may not be fixedly attached. The gap 280 may facilitate flexibility at the interface between the floor and ceiling panel 20 and the demising wall 200. The gap 280 may allow for flexing of the floor and ceiling panel 20 without damage to the demising wall 200 when loads are applied to or removed from the floor and ceiling panel 20.

In some embodiments, the hat channels 230, 235, 260, 265 may be implemented with steel. In some embodiments, the hat channels 230, 235, 260, 265 may be implemented with aluminum. In some embodiments, the hat channels 230, 235, 260, 265 may be implemented with plastic. Other suitable materials or a combination of materials may also be used. In some embodiments, the fire caulk 255 may be a latex-based, intumescent sealant.

In some embodiments, each SIP 212, 214 may include a magnesium oxide board 210, which may be coupled to a foam core 215, which may be coupled to a cement board 220 as described previously in reference to demising wall 100 shown in FIG. 1. In some embodiments, each SIP 212, 214 may be coupled to a finish wall panel 205 that may be coupled to the magnesium oxide board 210. As shown in FIG. 2, in some embodiments, the finish wall panel 205 may be coupled to the magnesium oxide board 210 by cleats 206. Other fasteners may also be used.

Figure 3:
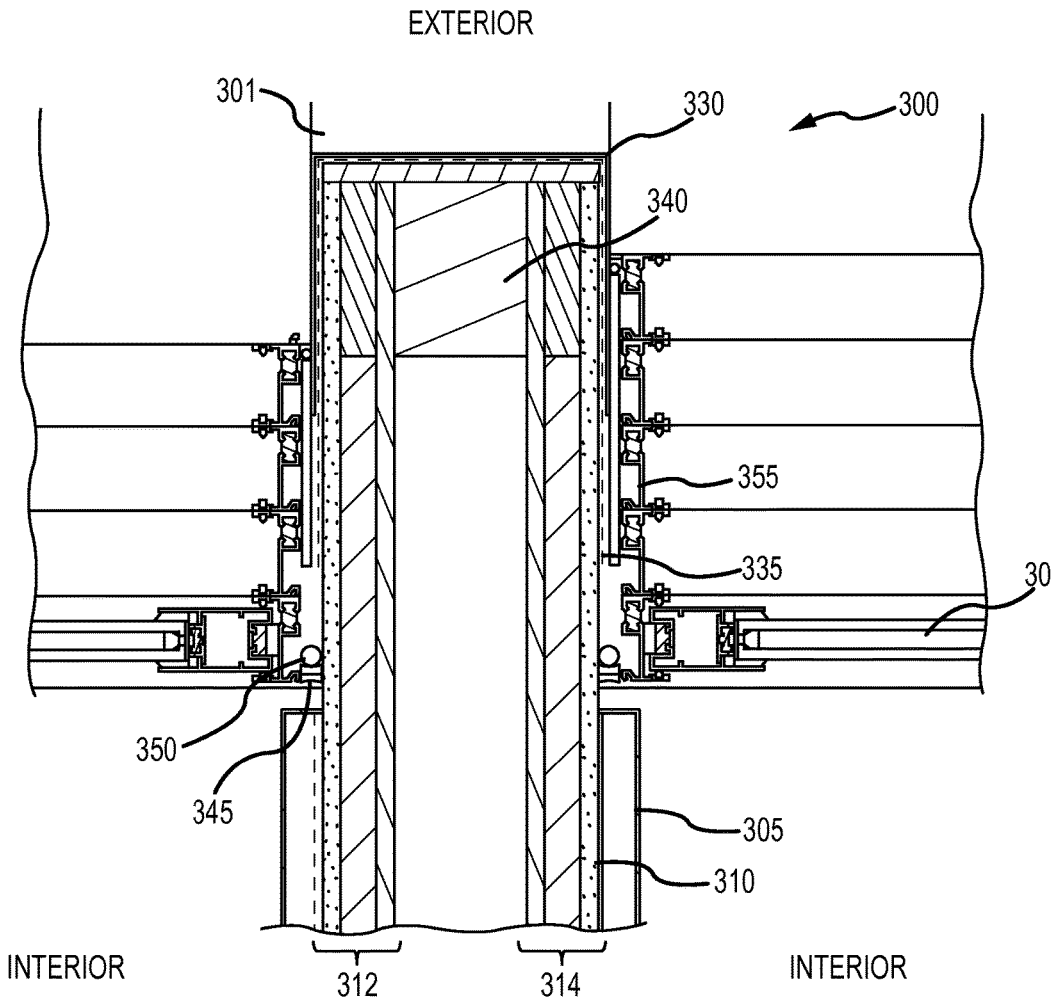
FIG. 3 is a schematic illustration of an embodiment of a demising wall interfacing with an embodiment of a window wall.

FIG. 3 is a schematic illustration of an embodiment of a demising wall 300 interfacing with an embodiment of a window wall 30. FIG. 3 shows a schematic illustration of a top-down view of an example demising wall 300 arranged in accordance with at least some embodiments described herein. FIG. 3 shows the demising wall 300 interfacing with a window wall 30. In some embodiments, shims 355 may be included between the window wall 30 and demising wall 300. An end 301 of the demising wall 300 may include a rigid insulation 340 to fill a void at an end 301 of the demising wall 300 adjacent to the window wall 30. The end 301 may be wrapped in a weather resistive barrier 335. As shown FIG. 3, the weather resistive barrier 335 may be wrapped into the window jamb of the window wall 30. A metal closure 330 may be placed over the weather resistive barrier 335 at the end 301. A sealant 345 and backer rod 350 may be applied to the interior interface between the demising wall 300 and window wall 30. The various components described in FIG. 3 are merely embodiments, and other variations, including eliminating components, combining components, and substituting components are all contemplated.

In some embodiments, the demising wall 300 may include two SIPS 312, 314. Each SIP 312, 314 may include similar components and configured similarly to the SIPS 112, 114 as described previously in reference to demising wall 100 shown in FIG. 1. In some embodiments, each SIP 312, 314 may be coupled to a finish wall panel 305 that may be coupled to the magnesium oxide board 310. As shown in FIG. 3, in some embodiments, the finish wall panel 305 does not extend beyond the window wall 30. In some embodiments, the weather resistive barrier 335 may be implemented using high-density polyethylene fibers.

Figure 4:
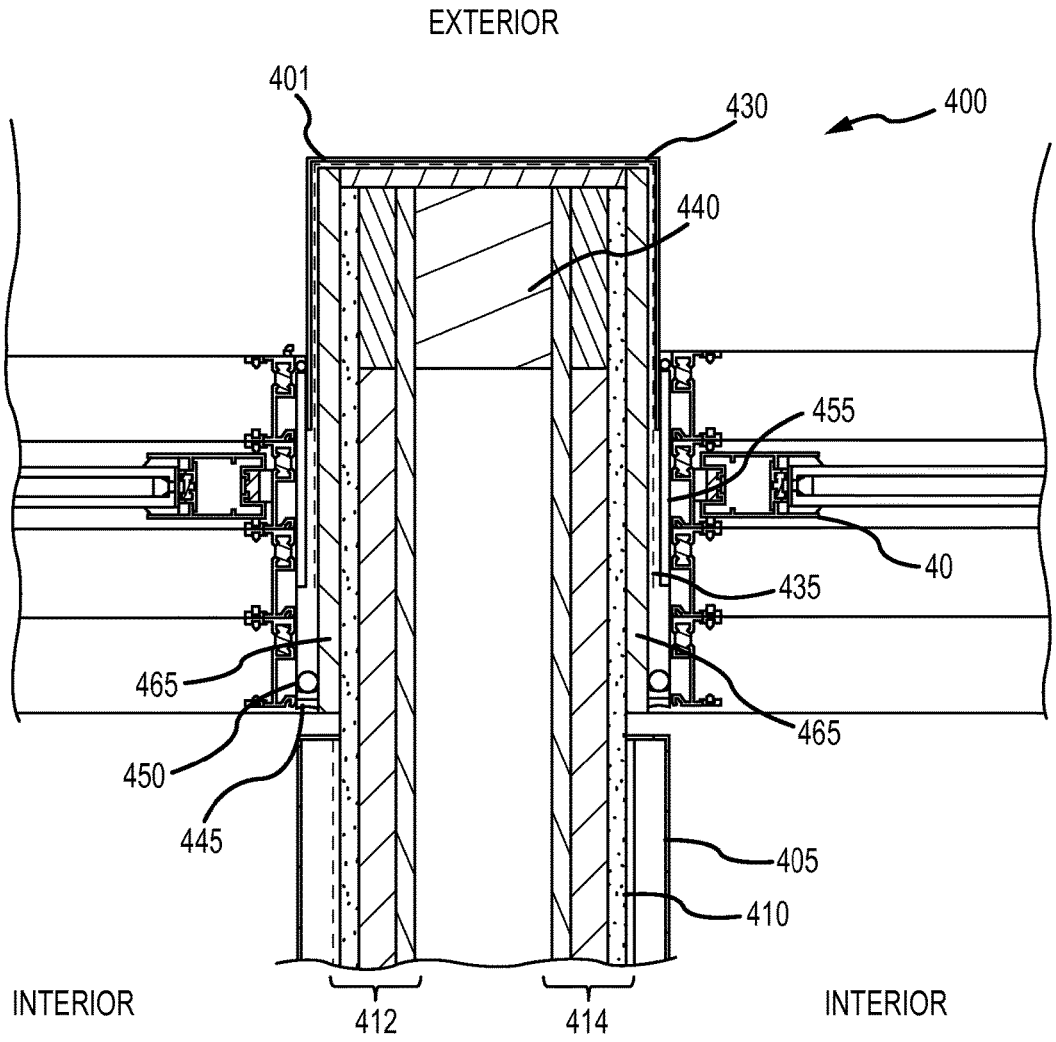
FIG. 4 is a schematic illustration of an embodiment of a demising wall interfacing with an embodiment of a window wall.

FIG. 4 is a schematic illustration of an embodiment of a demising wall 400 interfacing with an embodiment of a window wall 40. FIG. 4 shows a schematic illustration of a top-down view of an example demising wall 400 arranged in accordance with at least some embodiments described herein. FIG. 4 shows the demising wall 400 interfacing with a window wall 40. In some embodiments, shims 455 may be included between the window wall 40 and demising wall 400. An end 401 of the demising wall 400 may include a rigid insulation 440 to fill a void at an end 401 of the demising wall 400 adjacent to the window wall 40. The end 401 may be wrapped in a weather resistive barrier 435. As shown FIG. 4, the weather resistive barrier 435 may be wrapped into the window jamb of the window wall 40. A metal closure 430 may be placed over the weather resistive barrier 435 at the end 401. A sealant 445 and backer rod 450 may be applied to the interior interface between the demising wall 400 and window wall 40. The various components described in FIG. 4 are merely embodiments, and other variations, including eliminating components, combining components, and substituting components are all contemplated.

In some embodiments, the demising wall 400 may include two SIPS 412, 414. Each SIP 412, 414 may include similar components arranged in a similar manner as described previously in reference to demising wall 100 shown in FIG. 1. In some embodiments, each SIP 412, 414 may be coupled to a finish wall panel 405 that may be coupled to the magnesium oxide board 410. As shown in FIG. 4, in some embodiments, the finish wall panel 405 does not extend beyond the window wall 40. In some embodiments, the two SIPS 412, 414 include additional layers of cement board 465 at the interface with the window wall 40 proximate end 401. In some embodiments, the cement board 465 is 11 mm (7/16") thick. The additional layers of cement board 465 may not extend into an interior of the building beyond the window wall 460 in some embodiments.

Figure 5:
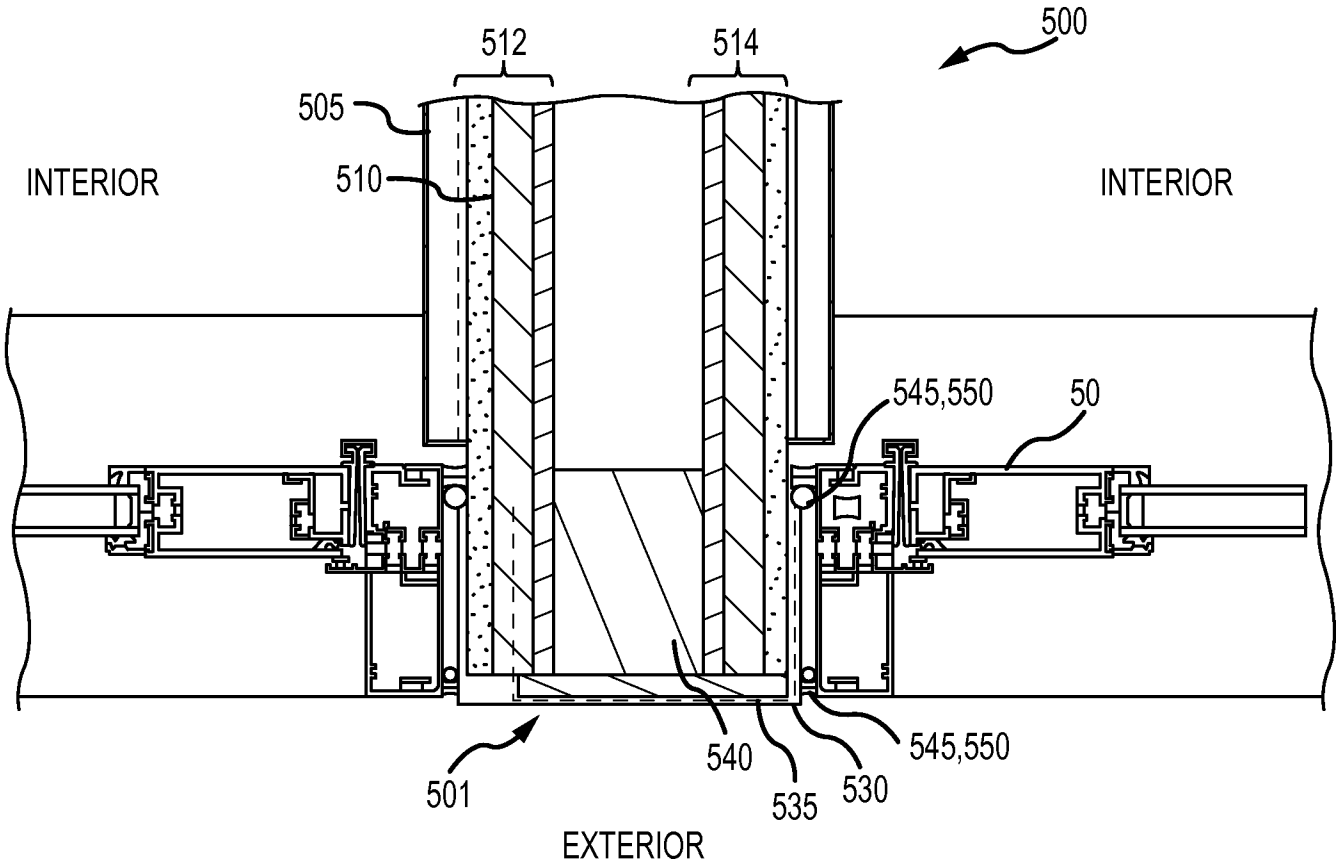
FIG. 5 is a schematic illustration of an embodiment of a demising wall interfacing with an embodiment of an entry door.

FIG. 5 is a schematic illustration of an embodiment of a demising wall 500 interfacing with an embodiment of an entry door 50. FIG. 5 shows a schematic illustration of a top-down view of an example demising wall 500 arranged in accordance with at least some embodiments described herein. FIG. 5 shows the demising wall 500 interfacing with an entry door 50. An end 501 of the demising wall 500 may include a rigid insulation 540 to fill a void at an end 501 of the demising wall 300 adjacent to the entry door 50. The end 501 may be wrapped in a weather resistive barrier 535. As shown FIG. 5, the weather resistive barrier 535 may be wrapped into the door jamb of the entry door 50. A metal closure 530 may be placed over the weather resistive barrier 535 at the end 501. A sealant 545 and backer rods 550 may be applied to the interior and exterior interfaces between the demising wall 500 and entry door 50. The various components described in FIG. 5 are merely embodiments, and other variations, including eliminating components, combining components, and substituting components are all contemplated.

In some embodiments, the demising wall 500 may include two SIPS 512, 514. Each SIP 512, 514 may include a magnesium oxide board 510, which may be coupled to a foam core 515, which may be coupled to a cement board 520 as described previously in reference to demising wall 100 shown in FIG. 1. In some embodiments, each SIP 512, 514 may be coupled to a finish wall panel 505 that may be coupled to the magnesium oxide board 510. As shown in FIG. 5, in some embodiments, the finish wall panel 505 does not extend beyond the entry door 50.

Figure 6:
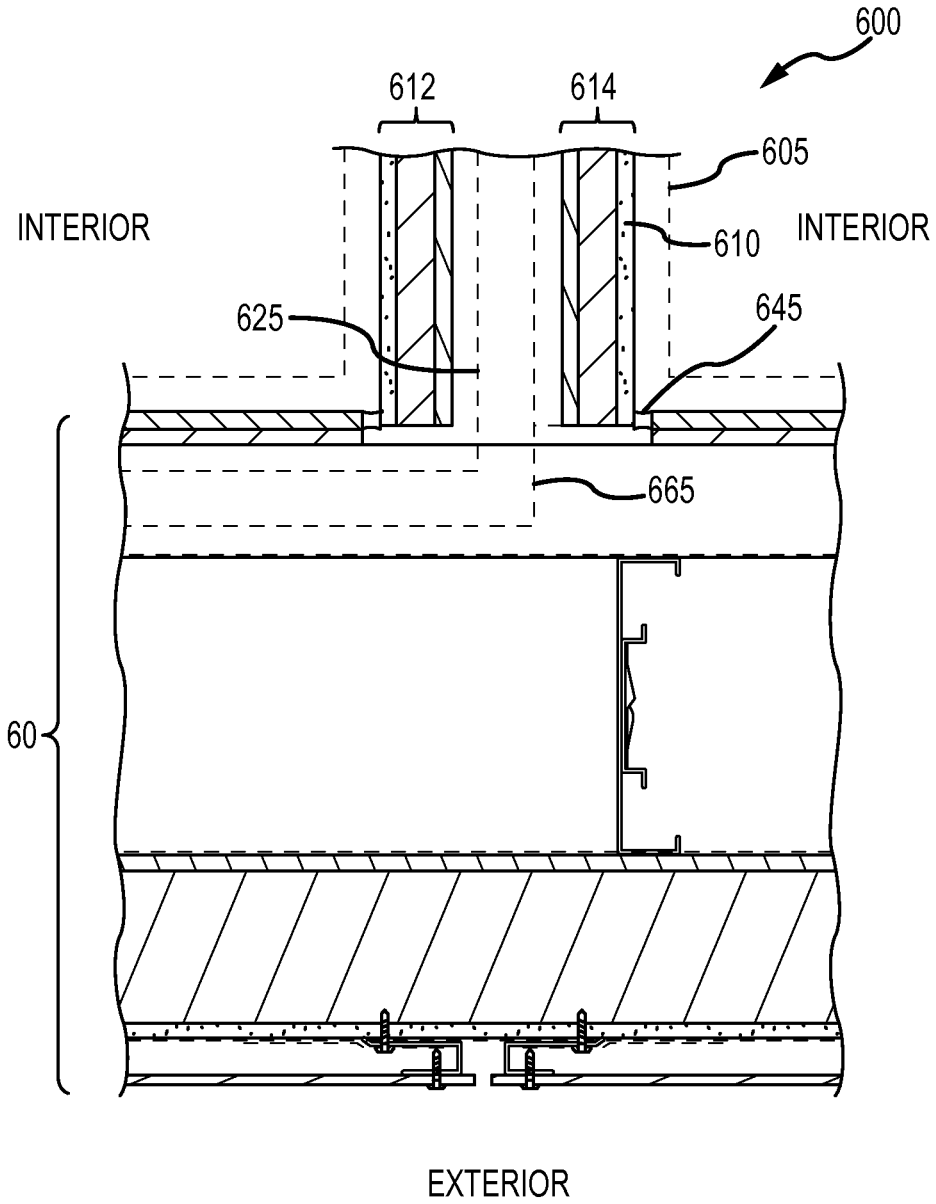
FIG. 6 is a schematic illustration of an embodiment of a demising wall interfacing with an embodiment of a utility wall panel.

FIG. 6 is a schematic illustration of an embodiment of a demising wall 600 interfacing with an embodiment of a utility wall panel 60. FIG. 6 shows a schematic illustration of a top-down view of an example demising wall 600 arranged in accordance with at least some embodiments described herein. FIG. 6 shows the demising wall 600 interfacing with a utility wall 60. A fire sealant 645 may be applied to the interface between the demising wall 600 and utility wall 60. In some embodiments, a fire sprinkler pipe 665 may pass from the utility wall 60 to the air space 625 of the demising wall 600. The various components described in FIG. 6 are merely embodiments, and other variations, including eliminating components, combining components, and substituting components are all contemplated.

In some embodiments, the demising wall 600 may include two SIPS 612, 614. Each SIP 612, 614 may include similar components arranged similarly as described previously in reference to demising wall 100 shown in FIG. 1. In some embodiments, each SIP 612, 614 may be coupled to a finish wall panel 605 that may be coupled to the magnesium oxide board 610. In some embodiments, electrical wires, data communication lines, plumbing, or a combination thereof may also pass from the utility wall 60 to the air space 625 of the demising wall 600.

FIGS. 3-6 illustrate demising walls 300, 400, 500, and 600 interfacing with other walls. The embodiments shown in FIGS. 3-6 are not limiting and a demising wall may interface with other types of walls and/or panels. In some embodiments, a demising wall may have more than one interface. For example, one end of the demising wall may interface with a window wall while the opposite end may interface with an entry door. In another example, a demising wall may interface with an entry door on one side and a window wall on the other side of the demising wall at the same end of the demising wall. In some embodiments, a demising wall may not interface with other walls. For example, the demising wall may only partially separate two interior spaces of a building unit, and passageways may pass on either end of the demising wall.

Figure 7:
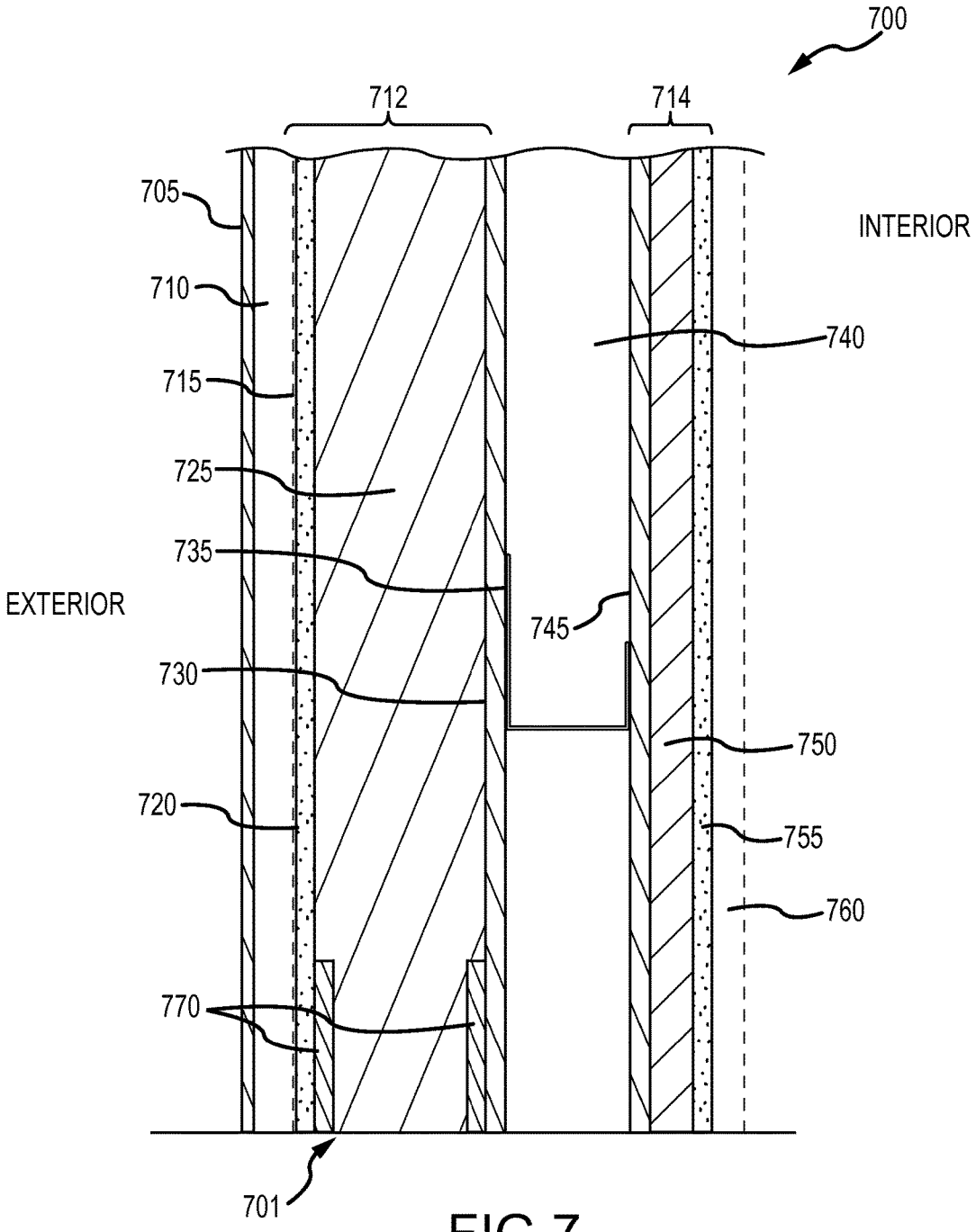
FIG. 7 is a schematic illustration of an embodiment of an end wall.

FIG. 7 is a schematic illustration of an embodiment of an end wall 700. FIG. 7 shows a schematic illustration of a side view of an example end wall panel 700 arranged in accordance with at least some embodiments described herein. FIG. 7 shows two structurally insulated panels (SIPS) 712, 714 arranged parallel to each other. SIP 712 may include a magnesium oxide board 720 coupled to a foam core 725 which is coupled to a cement board 730. The magnesium oxide board 720 may be coated with a weather resistive barrier 715 opposite the foam core 725. Vertical furring 710 may be coupled to the weather resistive barrier 715. The vertical furring 710 may be used to couple a cladding panel 705 to the SIP 712. The cladding panel 705 may form at least a portion of an external surface of the end wall panel 700. An end 701 of the SIP 712 may include additional layers of cement board 770 between the magnesium oxide board 720 and the foam core 725 and/or between the cement board 730 and foam core 725. In some embodiments, the additional layers of cement board 770 may not extend the entire length and/or height of the SIP 712.

SIP 714 may include a magnesium oxide board 755, which may be coupled to a foam core 750, which may be coupled to a cement board 745. The magnesium oxide board 755 may be coupled to a finish wall panel 760, which may provide at least a portion of an interior surface of the end wall panel 700.

The SIPS 712, 714 may be configured so that the cement boards 745, 730 are opposite one another and separated by an air space (e.g., interstitial space) 740, forming a portion of an interior of the end wall panel 700. The SIPS 712, 714 may be coupled by furring channel 735. Furring channel 735 may be coupled to cement boards 745,730. The various components described in FIG. 7 are merely embodiments, and other variations, including eliminating components, combining components, and substituting components are all contemplated.

The SIPS 712, 714 may be coupled to each other by hat channels (not shown in FIG. 7), as will be described in more detail below. Furring channel 735 may be 76 mm (3") wide in some embodiments. The furring channel 735 may be implemented using aluminum, steel, plastic, other suitable materials, or a combination of materials. The SIPS 712, 714 may both span a distance between a floor and a ceiling of a building unit. There may not be any studs—including any metal studs—between the SIPS 712, 714. In this manner, the end wall panel 700 may provide a stud-free wall implementation. In some embodiments, the furring channel 735 may provide chases and/or support for utilities (e.g., telecommunications cables, fire sprinkler pipes, electrical wires) in the end wall panel 700.

In some embodiments, the weather resistive barrier 715 may be implemented using high-density polyethylene fibers. In some embodiments, the weather resistive barrier 715 may be implemented using spun-bonded polypropylene. In some embodiments, the weather resistive barrier may have an adhesive applied to one surface for attachment to the magnesium oxide board 720. Other moisture-resistant materials may be used for the weather resistive barrier 715. Vertical furring 710 may be implemented using wood, aluminum, steel, plastic, other suitable materials, or a combination of materials. In some embodiments, the vertical furring 710 may be 25.5 mm (1") furring spaced every 61 cm (2') along the end wall panel 700. The cladding panel 705 may act as a rain shield. The cladding panel 705 may be implemented with a metallic material or a polymer material in some embodiments. In some embodiments, the cladding panel 705 may be made of a variety of materials. In some embodiments, the cladding panel 705 is implemented with multiple cladding panels. The cladding panels may be identical or some cladding panels may be implemented with a different material than other cladding panels.

In some embodiments, the magnesium oxide boards 720, 755 are 12 mm (15/32") thick. In some embodiments, the foam core 725 is a 101.6 mm (4") thick polystyrene expanded foam plastic core. In some embodiments, the foam core 750 is a 25.4 mm (1") thick polystyrene expanded foam plastic core. In some embodiments, the cement boards 730, 745 are 11 mm (7/16") thick. In some embodiments, the air space 740 is 76 mm (3") wide. Other thicknesses for the foam cores 725, 750, boards 720, 755, 730, 745, and/or air space 740 may be used. Different thicknesses and materials may be chosen based on the environmental requirements of the structure. In some embodiments, the magnesium oxide boards 720, 755 and fiber cement boards 730, 745 may completely cover opposite surfaces of the foam cores 115. In some embodiments, the magnesium oxide board 720, 755 and/or fiber cement board 730, 745 may be implemented with plywood. In some embodiments, the magnesium oxide board 720, 755 and/or fiber cement board 730, 745 may be implemented with light-weight pre-cast concrete. Any other suitable construction material may be used in some embodiments. In some embodiments one or more of the boards 720, 755, 730, 745 may extend beyond one or more edges of the foam cores 725, 750. In some embodiments, the foam cores 725, 750 may extend beyond one or both boards 720, 755, 730, 745 along one or more edges. In some embodiments, SIP 712 or 714 may extend beyond the other SIP 712 or 714 along one or more edges.

The finish wall panel 760 may be paint applied to the magnesium oxide board 755 in some embodiments. In some embodiments, the finish wall panel 760 may be one or more decorative panels coupled to the magnesium oxide board 755. The one or more decorative panels may be implemented with glass panes, plastic, wood veneer, and/or other desired interior finish. The finish wall panel 760 may provide a portion of an interior finish of a wall of a room of a building unit (e.g., office, living room, bedroom).

Figure 8:
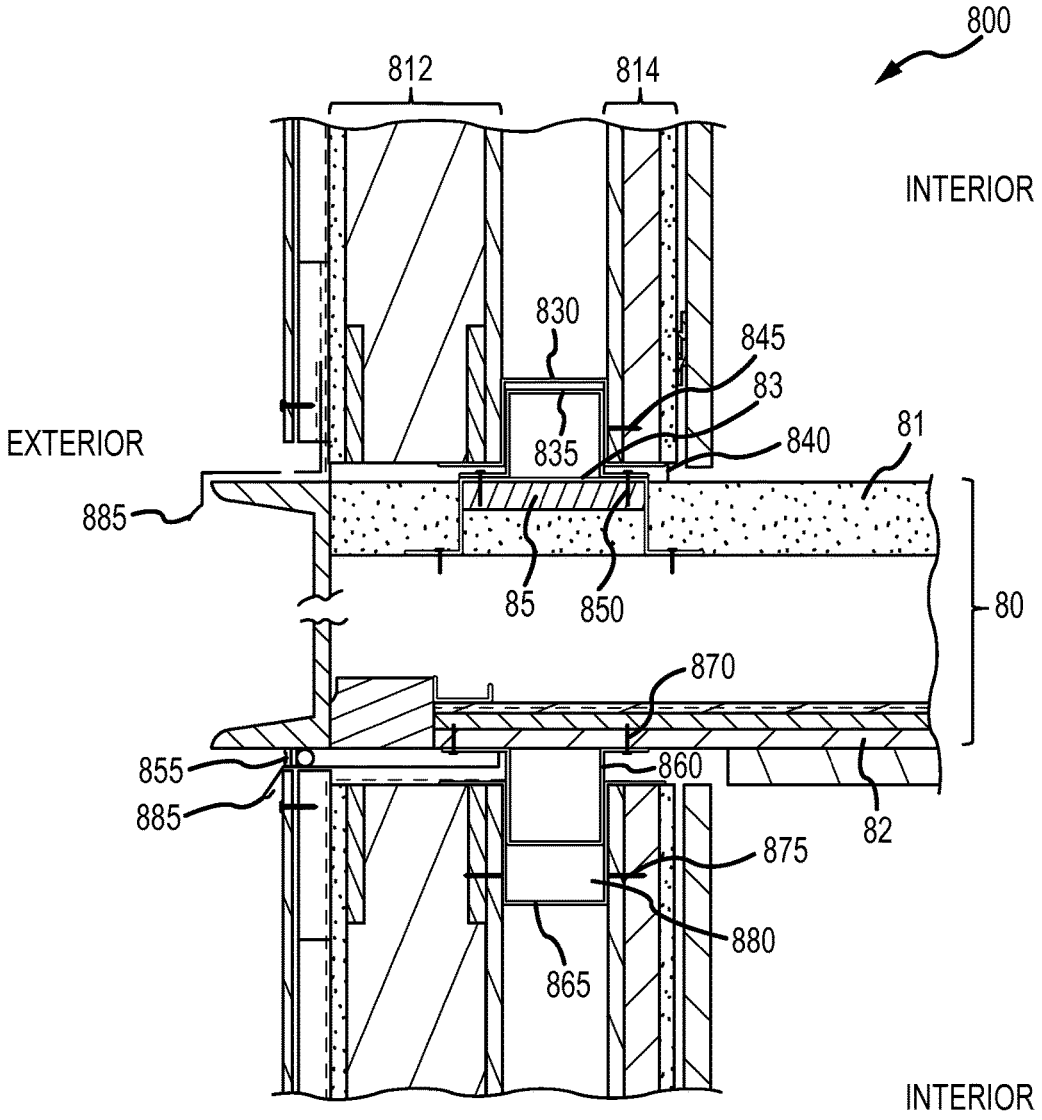
FIG. 8 is a schematic illustration of an embodiment of an end wall interfacing with an embodiment of a floor and ceiling panel.

FIG. 8 is a schematic illustration of an embodiment of an end wall 800 interfacing with an embodiment of a floor and ceiling panel 80. FIG. 8 shows a schematic illustration of a side view of an example end wall panel 800 arranged in accordance with at least some embodiments described herein. FIG. 8 shows two SIPS 812, 814 of the end wall panel 800 coupled to a first hat channel 830. The two SIPS

812, 814 may be coupled to a second hat channel 865. In some embodiments, the second hat channel 865 may be coupled to the SIPS 812, 814 by fasteners 875. The fasteners 875 may be implemented with screws, bolts, nails, other suitable fasteners, or a combination thereof. The first and second hat channels 830, 865 may be coupled to opposite ends of the end wall panel 800. The various components described in FIG. 8 are merely embodiments, and other variations, including eliminating components, combining components, and substituting components are all contemplated.

In some embodiments, the end wall panel 800 may interface with a floor and ceiling panel 80 as shown in FIG. 8. The first hat channel 830 may be along an edge of the end wall panel 800 that couples to a floor 81 of a floor and ceiling panel 80. The first hat channel 830 included in the end wall panel 800 may nest with a first sister hat channel 835 coupled to the floor 81. The second hat channel 865 may be along an edge of the end wall panel 800 that couples to a ceiling 82 of the floor and ceiling panel 80. The second hat channel 865 may next with a second sister hat channel 860 coupled to the ceiling 82. By nesting, it is meant that the dimensions of the hat channels 830, 865 are such that the interiors of the hat channels 830, 865 fit around the exteriors of the sister hat channels 835, 860.

In some embodiments, the first sister hat channel 835 may be coupled to the floor 81. In some embodiments, the floor 85 may have a concrete surface. In some embodiments, the floor 81 may have a wood surface. In some embodiments, the sister hat channel 835 may be nailed, screwed, or bolted to the floor 81. The floor 81 may already have fasteners, such as bolts and/or screws, installed in the floor 85. As shown in FIG. 8, in some embodiments, a hat channel 83 including a foam strip 85 may be embedded in the concrete of the floor 81. The first sister hat channel 835 may be coupled to the hat channel 83 by embedding fasteners 850 through the hat channel 83 into the foam strip 85. In some embodiments, once the first hat channel 830 is nested with the first sister hat channel 835, the hat channels 830, 835 are coupled by a fastener 845. The fastener may pass through SIP 214. The fastener 845 may be implemented with a screw, a bolt, a nail, or other suitable fastener. In some embodiments, a compressible fire sealant 840 may be between the floor 81 and the SIPS 812, 814.

In some embodiments, the second sister hat channel 860 may be coupled to a surface of the ceiling 82 by fasteners 870. The fasteners 870 may be implemented with screws, bolts, nails, other suitable fasteners, or a combination thereof. In some embodiments, fire caulk 855 may be between the ceiling 82 and SIPS 812, 814. As shown in FIG. 8, in some embodiments, the second hat channel 865 may be deeper than the second sister hat channel 860. In this manner, a gap 880 may be defined between the two hat channels 860, 865. The two hat channels 860, 865 may not be fixedly attached. The gap 880 may facilitate flexibility at the interface between the floor and ceiling panel 80 and the end wall panel 800. The gap 880 may allow for flexing of the floor and ceiling panel 80 without damage to the end wall panel 800 when loads are applied to or removed from the floor and ceiling panel 80.

In some embodiments, the hat channels 830, 835, 860, 865 may be implemented with steel. In some embodiments, the hat channels 830, 835, 860, 865 may be implemented with aluminum. In some embodiments, the hat channels 830, 835, 860, 865 may be implemented with plastic. Other suitable materials or a combination of materials may also be used.

In some embodiments, the end wall panel 800 may include two SIPS 812, 814 and have a similar structure and materials as the end wall panel 700 described in reference to FIG. 7. In some embodiments, flashing 885 may be coupled at an exterior interface of the SIP 812 and floor and ceiling panel 80. In some embodiments, the flashing 885 may be rubber. In some embodiments, the flashing 885 may be non-woven polypropylene fibers. In some embodiments, the flashing 885 may include an acrylic ester polymer adhesive for coupling to the joint formed by the SIP 812 and floor and ceiling panel 80. Any other suitable construction material may be used in some embodiments.

Figure 9:
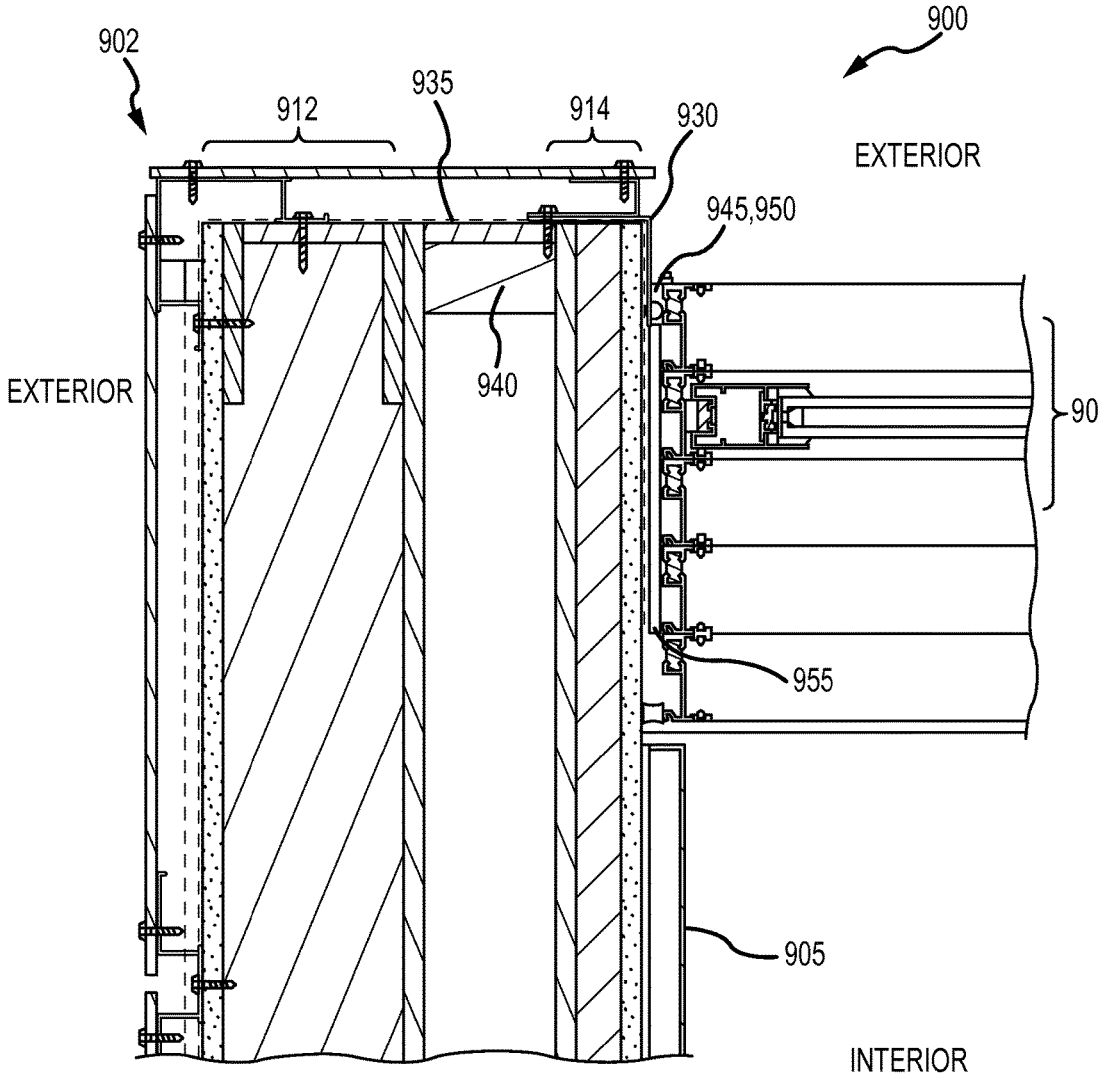
FIG. 9 is a schematic illustration of an embodiment of an end wall interfacing with an embodiment of a window wall.

FIG. 9 is a schematic illustration of an embodiment of an end wall 900 interfacing with an embodiment of a window wall 90. FIG. 9 shows a schematic illustration of a top-down view of an example end wall panel 900 arranged in accordance with at least some embodiments described herein. FIG. 9 shows the end wall panel 900 interfacing with a window wall 90. In some embodiments, shims 955 may be included between the window wall 90 and end wall panel 900. An end 902 of the end wall panel 900 may include a rigid insulation 940 to fill a void at an end 902 of the end wall panel 900 adjacent to the window wall 90. The end 902 may be wrapped in a weather resistive barrier 935. As shown FIG. 9, the weather resistive barrier 935 may be wrapped into the window jamb of the window wall 90. A metal closure 930 may be placed over the weather resistive barrier 935 at the end 902. A sealant 945 and backer rod 950 may be applied to the exterior interface between the end wall panel 900 and window wall 90. The various components described in FIG. 9 are merely embodiments, and other variations, including eliminating components, combining components, and substituting components are all contemplated.

In some embodiments, the end wall panel 900 may include two SIPS 912, 914 and have a similar structure and materials as the end wall panel 700 described in reference to FIG. 7. In some embodiments, SIP 914 may be coupled to a finish wall panel 905. As shown in FIG. 9, in some embodiments, the finish wall panel 905 does not extend beyond the window wall 90.

Figure 10:
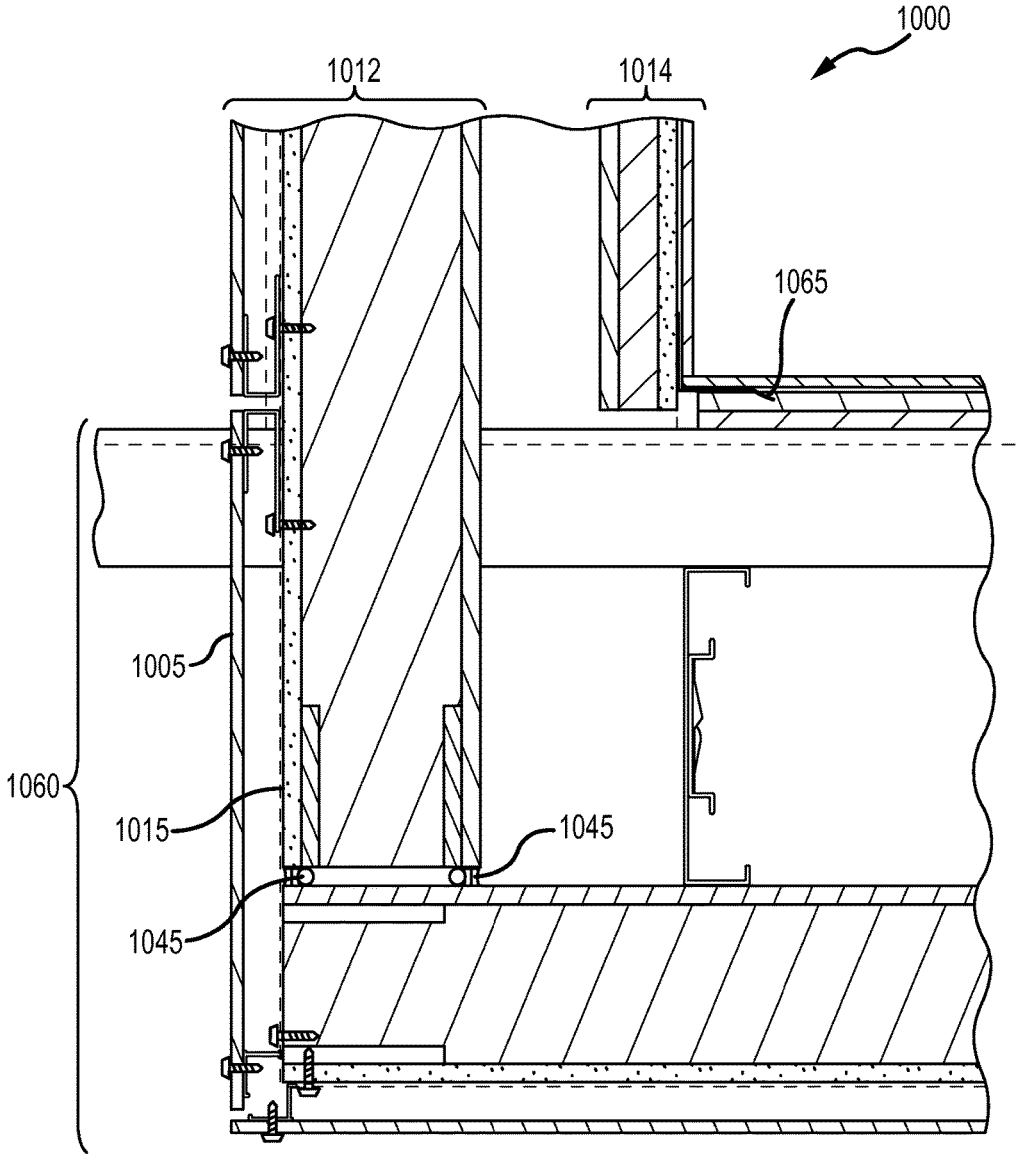
FIG. 10 is a schematic illustration of an embodiment of an end wall interfacing with an embodiment of a utility wall panel.

FIG. 10 is a schematic illustration of an embodiment of an end wall 1000 interfacing with an embodiment of a utility wall panel 1060. FIG. 10 shows a schematic illustration of a top-down view of an example end wall panel 1000 arranged in accordance with at least some embodiments described herein. FIG. 10 shows the end wall panel 1000 interfacing with a utility wall 1060. The end wall panel 1000 may include two SIPS 1012, 1014. As shown in FIG. 10, SIP 1012 may extend beyond SIP 1014 to interface with the utility wall 1060. A fire sealant 1045 and backer rod 1050 may be applied to the interface between the SIP 1012 and utility wall 1060. A weather resistive barrier 1015 may extend from SIP 1012 to the utility wall 1060 and coupled to both the SIP 1012 and utility wall 1060, which may provide a water resistant seal. A cladding panel 1005 may extend from SIP 1012 to utility wall 1060 and be coupled to both the SIP 1012 and utility wall 1060. A closure angle 1065 may couple the interior interface between the utility wall 1060 and SIP 1014. The various components described in FIG. 10 are merely embodiments, and other variations, including eliminating components, combining components, and substituting components are all contemplated.

In some embodiments, the two SIPS 1012, 1014 and have a similar structure and materials as the end wall panel 700 described in reference to FIG. 7. In some embodiments, the closure angle 1065 may be implemented with steel. In some embodiments, the closure angle 1065 may be implemented with aluminum or wood. Other suitable materials may be used.

FIGS. 9-10 illustrate end wall panels 900, 1000 interfacing with other walls. The embodiments shown in FIGS. 9-10 are not limiting and an end wall panel may interface with other types of walls and/or panels. In some embodiments, an end wall panel may have more than one interface. For example, one end of the end wall panel may interface with a window wall while the opposite end may interface with a utility panel.

Figure 11:
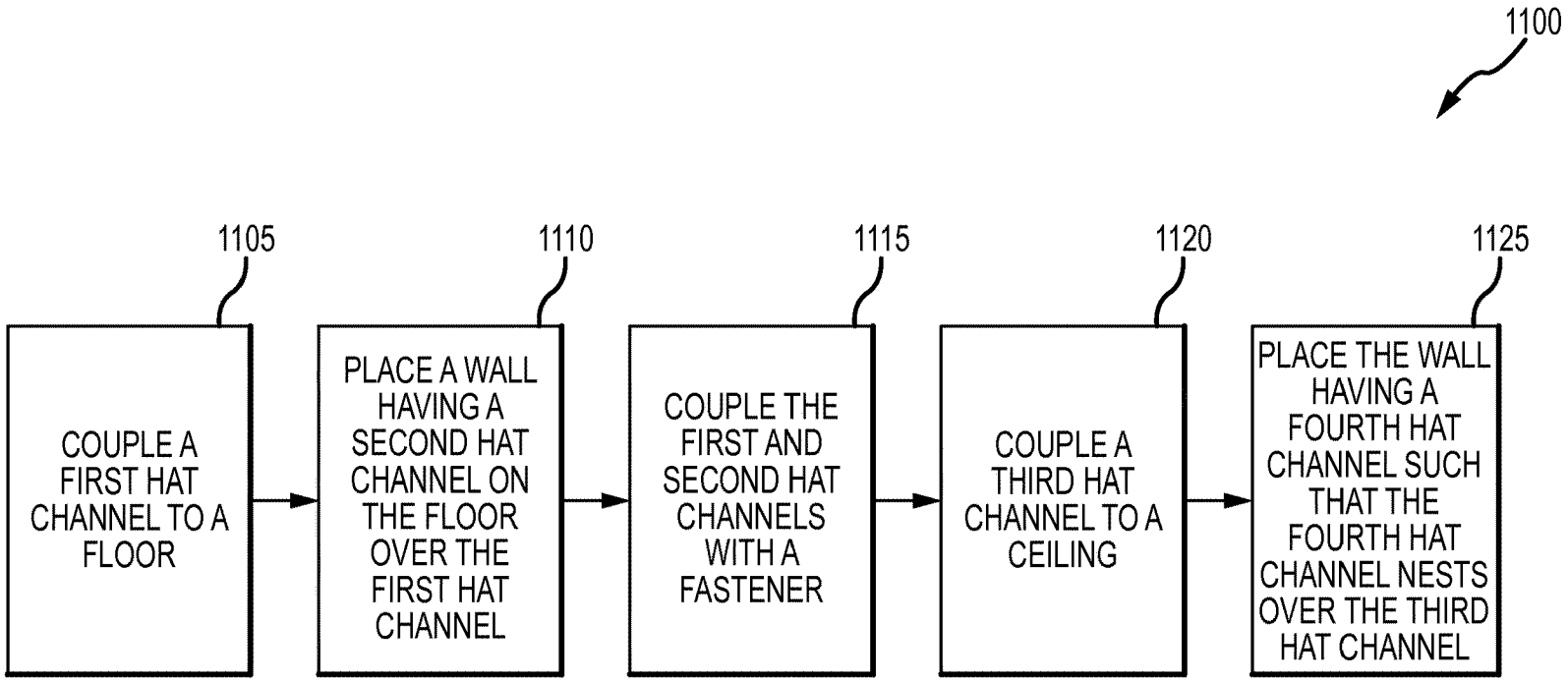
FIG. 11 shows a flowchart illustrating an example method.

FIG. 11 shows a flowchart illustrating an example method 1100. An example method may include one or more operations, functions or actions as illustrated by one or more of blocks 1105, 1110, 1115, 1120, and/or 1125. The example method 1100 may be used to couple a wall panel, for example, the utility panel, to a structure.

An example process may begin with block 1105, which recites "couple a first hat channel to a floor." Block 1105 may be followed by block 1110, which recites "place a wall having a second hat channel on the floor over the first hat channel." Block 1110 may optionally be followed by block 1115, which recites, "couple the first and second hat channels with a fastener." Block 1115 may optionally be followed by block 1120, which recites, "couple a third hat channel to a ceiling." Block 1120 may be optionally followed by block 1125, which recites, "place the wall having a fourth hat channel such that the fourth hat channel nests over the third hat channel."

The blocks included in the described example methods are for illustration purposes. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc. In some embodiments, the optional blocks may be omitted.

Block 1105 recites, "couple a first hat channel to a floor." The floor may be part of a floor and ceiling panel in some embodiments. The floor may be wood, concrete, steel, or a combination of materials. In some embodiments, the first hat channel is implemented using steel, aluminum, or a combination of materials. In some embodiments, the first hat channel is coupled to the floor with screws. In some embodiments, the first hat channel is coupled to the floor with bolts. Other coupling methods may be used.

Block 1110 recites, "place a wall having a second hat channel on the floor over the first hat channel." In some embodiments, the wall may be a demising wall. In some embodiments, the wall may be an end wall panel. In some embodiments, the second hat channel is coupled to two SIPS panels. The second hat channel may nest over the first hat channel in some embodiments. The wall may be placed by a crane in some embodiments. In some embodiments, the wall may be placed by one or more workers.

Block 1115 recites, "couple the first and second hat channels with a fastener." In some embodiments, the first and second hat channels are coupled with a screw. In some embodiments, the first and second hat channels are coupled with a bolt. Other fasteners may also be used. In some embodiments, the fastener passes at least partially through the wall. In some embodiments, the weight of the wall and/or height of the hat channels is sufficient to couple the first and second hat channels and Block 1115 may be omitted.

Block 1120 recites, "couple a third hat channel to a ceiling." The ceiling may be part of a floor and ceiling panel in some embodiments. The ceiling may be wood, concrete, steel, or a combination of materials. In some embodiments, the third hat channel is implemented using steel, aluminum, or a combination of materials. In some embodiments, the third hat channel is coupled to the ceiling with screws. In some embodiments, the third hat channel is coupled to the ceiling with bolts. Other coupling methods may be used.

Block 1125 recites, "place the wall having a fourth hat channel such that the fourth hat channel nests over the third hat channel." In some embodiments, the fourth hat channel is coupled to two SIPS panels. The fourth hat channel may nest over the third hat channel in some embodiments. In some embodiments, the fourth hat channel is deeper than the third hat channel such that a gap is formed between the third and fourth hat channels. The gap may facilitate protecting the wall from flexing of the ceiling.

Embodiment demising and end walls may have several advantages, including: (a) they may be fully integrated with electrical, fire protection, plumbing, venting, and other building system capabilities; (b) they may have both interior and exterior finishes; (c) the end walls may have a complete weather barrier system that is double-redundant; (d) they may be fully insulated for energy and sound; and (e) they may meet all fire, energy and life/safety building codes. It is to be understood that not all embodiments of demising and end walls may have all, or even any of the described advantages, which are provided to facilitate appreciation of some aspects described herein.

Embodiments of pre-assembled panels described herein, including the demising walls and end wall panels, may provide interior and/or exterior walls in mid-rise and high-rise residential projects, among others. The panels may be configured to comply with one or more of the following building codes: fire, energy, handicap, life-safety, and acoustical (impact and ambient noise transfer). The panels may also be configured to comply with social and/or religious codes as desired. In some embodiments, the demising walls and end wall panels may be considered as a fully-integrated sub-assembly meeting fire, sound impact, energy, and life/safety codes. The demising walls and end wall panels may be fully integrated with electrical, fire protection, energy insulation, and sound isolation capabilities in some embodiments. The demising walls and end wall panels may be designed to achieve a fire rating set by the applicable building code, such as a two-hour fire rating. Materials, systems, methods, and/or apparatuses may be configured to comply with the International Building Code as it has been adopted in a jurisdiction.

The demising walls and end wall panels described herein may be fabricated off-site in a factory or shop and transported to the project jobsite for attachment to a structural frame, such as a structural exoskeleton, of a building. The panels may be fabricated in various sizes, such as nine feet by twenty-two feet. Smaller infill panels may be prefabricated on a project-by-project basis to complete the building wall system. At the building site, the demising walls and end wall panels may be attached to floor panels, ceiling panels, other end walls, other demising walls, utility walls, building utilities, or any combination thereof. The demising walls and end wall panels may provide support the overall exterior and/or interior wall system, which may include an exterior steel frame installed in the field in some embodiments.

In some embodiments, a pre-assembled floor and ceiling panel may be obtained and used as a floor in a multi-story building that includes the demising walls and end wall panels. In some embodiments, the demising walls and end wall panels form joints with the floor and ceiling panel on the interior and/or exterior of the multi-story building. In some embodiments, the floor and ceiling panel may have been assembled at a different location than the building site, however it may in some embodiments be assembled at the building site. In some embodiments, the pre-assembled panel may include a closure piece that may facilitate the coupling of a window wall to the floor and ceiling panel along an edge opposite and/or adjacent to the demising walls and end wall panels. In some embodiments, the closure piece is coupled to the floor and ceiling panel at a later point in time. The floor and ceiling panels may include a plurality of joists and a corrugated form deck disposed above and attached to the plurality of joists. In some embodiments, the closure piece is coupled to the deck. In some embodiments, the closure piece is coupled to one or more of the joists. In some embodiments, the closure piece is coupled to both the deck and the joists. In some embodiments, the closure piece is on an opposite edge of the floor and ceiling panel as an edge of the floor and ceiling panel that forms a joint with the utility panel.

The floor and ceiling panel may be attached to the frame of a building. For example, the floor and ceiling panel may be attached to an exterior steel structure, which may provide the structural support for a building. Generally, any mechanism may be used to attach the floor and ceiling panel, or multiple floor and ceiling panels, to the frame of the building, such as an external steel structure. Any type of fastening may generally be used.

Concrete may be poured onto the floor and ceiling panel. Pouring the concrete may form a diaphragm of the building, which may span an entire story of the building in some embodiments. In some embodiments, the diaphragm may transmit lateral loads to the lateral load system of the building. In this manner, the concrete may be poured at the completed height of the story of the building, after the floor and ceiling panels have been positioned at the desired story, thereby forming the floor of units in that story. In some embodiments, the demising walls and end wall panels are installed after the concrete has cured on the floor and ceiling panels.

Embodiments of pre-assembled floor and ceiling panels may provide a floor and ceiling system useable in mid-rise and high-rise residential projects, among others. The panels with or without the closure pieces and tracks installed may be configured to comply with one or more of the following building codes: fire, energy, handicap, life-safety, and acoustical (impact and ambient noise transfer). In some embodiments, the pre-assembled floor and ceiling panels with or without the closure pieces and tracks may be considered as a fully-integrated sub-assembly meeting fire, sound impact, energy, and life/safety codes. The floor and ceiling panels may be fully integrated with electrical, fire protection, energy insulation, and sound isolation capabilities in some embodiments. The floor and ceiling panels may be designed to achieve a fire rating set by the applicable building code, such as a two-hour fire rating.

The floor and ceiling panels described herein may be fabricated off-site in a factory or shop and transported to the project jobsite for attachment to a structural frame, such as a structural exoskeleton, of a building. The panels and closure pieces may be fabricated in various sizes, such as eight feet by twenty-two feet. Smaller infill panels may be prefabricated on a project-by-project basis to complete the building floor system. At the building site, the panel may be attached to end walls, demising walls, utility panels, building utilities, or any combination thereof. The floor and ceiling panel may provide support the overall floor system, which may include a concrete topping slab poured in the field to create a structural diaphragm for the building. In some embodiments, the floor and ceiling panel transfers loads to the utility panel. In some embodiments, the floor and ceiling panel transfers loads directly to a steel structure of the building, and the utility panel does not translate loads from the floor and ceiling panel to the structure. In some embodiments, the utility panel is non-load bearing.

Example I

In a first non-limiting example, a prefabricated demising wall may include a first structurally insulated panel (SIP). The SIP may be made of a 12 mm magnesium oxide board coupled to a 25.4 mm thick polystyrene foamed plastic core. A 11 mm cement board may be coupled to a surface of the polystyrene foamed plastic core opposite the magnesium oxide board. The demising wall may further include a second SIP made of the same materials as the first SIP. The first and second SIPS may be configured such that the magnesium oxide boards are proximate each other. The two SIPS may be coupled along two parallel edges of the demising wall by hat channels. The hat channels may maintain a 76 mm wide interstitial space between the first and second SIPS. The hat channels may be light gauge steel. The demising wall may include a finishing panel coupled to the magnesium oxide boards of the first and second SIPS. The finish panel may be a sheet of plastic. The demising wall may be nine feet high and twenty-two feet long.

Example II

In a second non-limiting example, a prefabricated demising wall may include a first structurally insulated panel (SIP). The first SIP may be made of a plywood board coupled to a 25.4 mm thick polystyrene foamed plastic core. A second plywood board may be coupled to a surface of the polystyrene foamed plastic core opposite the first plywood board. The demising wall may further include a second SIP made of the same materials as the first SIP. The two SIPS may be coupled along two opposite edges of the demising wall by hat channels. The hat channels may maintain a 76 mm wide interstitial space between the first and second SIPS. The hat channels may be formed from polyvinyl chloride (PVC). The demising wall may include a finishing panel coupled to the exterior plywood boards of the first and second SIPS. The finish panel may be a thin wood veneer. The demising wall may be nine feet high and twenty-two feet long

Example III

In a third non-limiting example, a prefabricated end wall panel may include two structurally insulated panels (SIPS). The first SIP may include a 12 mm magnesium oxide board coupled to a 101.6 mm thick polystyrene foamed plastic core. A 11 mm cement board may be coupled to a surface of the polystyrene foamed plastic core opposite the magnesium oxide board. The second SIP may be made of a 12 mm magnesium oxide board coupled to a 25.4 mm thick polystyrene foamed plastic core. An 11 mm cement board may be coupled to a surface of the polystyrene foamed plastic core opposite the magnesium oxide board. The two SIPS may be coupled by a horizontal 76 mm wide furring channel. The furring channel may be light gauge steel. The two SIPS may be coupled such that the cement boards are proximate each other. The two SIPS may be further coupled along two opposite edges of the end wall panel by hat channels. The hat channels may maintain a 76 mm wide interstitial space between the first and second SIPS. The hat channels may be light gauge steel.

A weather resistive barrier may be applied to the magnesium oxide board of the first SIP. The weather resistive barrier may be a multi-layer spun-bonded polypropylene. Light gauge steel 25.4 mm vertical furring channels may be coupled to the magnesium oxide board over the weather resistive barrier. The furring channels may be spaced every 61 cm. Multiple cladding panels may be coupled to the furring channels. The cladding panels may be painted light gauge steel. The panels may act as both a decorative finish and a rain shield.

The second SIP may include a finishing panel coupled to the magnesium oxide board. The finishing panel may be a plurality of colorful plastic panels. The plastic panels may be coupled to the magnesium oxide board by cleats. The plastic panels may act as a decorative finish for the interior of a room.

The examples provided are for explanatory purposes only and should not be considered to limit the scope of the disclosure. Each example embodiment may be practical for a particular environment such as urban mixed-use developments, low-rise residential units, and/or remote communities. Materials and dimensions for individual elements may be configured to comply with one or more of the following building codes: fire, energy, handicap, life-safety, and acoustical (impact and ambient noise transfer) without departing from the scope of the principles of the disclosure. The elements and/or system may also be configured to comply with social and/or religious codes as desired. For example, materials, systems, methods, and/or apparatuses may be configured to comply with the International Building Code as it has been adopted in a jurisdiction.

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For embodiment, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For embodiment, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting embodiment, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for embodiment, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely embodiments, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably coupleable", to each other to achieve the desired functionality. Specific embodiments of operably coupleable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A wall, comprising:

a first structurally insulated panel (SIP);

a second SIP opposite the first SIP;

a first hat channel that couples the first SIP and the second SIP along a first edge of the wall, wherein the first hat channel forms a first recess within an interior of the wall, wherein the first recess includes an opening to an exterior of the first edge of the wall, wherein the first hat channel extends lengthwise along the first edge of the wall, and wherein the first edge of the wall extends lengthwise along a floor when the wall is installed in a structure, wherein each of the first SIP and the second SIP comprises:

a foam core;

a magnesium oxide board coupled to a first surface of the foam core; and a fiber cement board coupled to a second surface of the foam core, wherein the second surface is opposite the first surface;

a weather resistive barrier coupled to the magnesium oxide board of the first SIP; and a vertical furring channel coupled to the first SIP over the weather resistive barrier.

2. The wall of claim 1, wherein the first hat channel is configured to nest with a first sister hat channel coupled to the floor and configured to extend lengthwise along the floor in a same orientation as the first hat channel when the wall is installed in the structure, and wherein the first sister hat channel nests within the first recess formed by the first hat channel.

3. The wall of claim 1, further comprising a second hat channel coupled between the first SIP and the second SIP along a second edge of the wall, wherein the second edge is opposite the first edge, wherein the second hat channel forms a second recess within the interior of the wall, wherein the second recess includes an opening to an exterior of the second edge of the wall, and wherein the second edge of the wall extends lengthwise along a ceiling when the wall is installed in the structure.

4. The wall of claim 3, wherein the second hat channel is configured to nest with a second sister hat channel coupled to the ceiling and configured to extend lengthwise along the ceiling in a same orientation as the second hat channel when the wall is installed in the structure, and wherein the second sister hat channel nests within the second recess formed by the second hat channel.

5. The wall of claim 4, wherein a gap is formed between the second hat channel and the second sister hat channel.

6. The wall of claim 3, wherein the second hat channel is deeper than the first hat channel.

7. The wall of claim 1, further comprising a finishing panel coupled to the magnesium oxide board.

8. The wall of claim 7, wherein the finishing panel is coupled to the magnesium oxide board by a cleat.

9. The wall of claim 1, wherein the first SIP and the second SIP are coupled to the first hat channel, such that the fiber cement board of the first SIP and the fiber cement board of the second SIP are proximate each other.

10. The wall of claim 1, wherein the foam core of the first SIP is thicker than the foam core of the second SIP.

11. The wall of claim 1, further comprising a cladding panel coupled to the vertical furring channel.

12. The wall of claim 1, further comprising a sprinkler pipe between the first SIP and the second SIP.

13. The wall of claim 1, wherein the first SIP and the second SIP are further coupled by a horizontal furring channel.

14. A method, comprising:

placing a wall that includes a first hat channel over a second hat channel coupled to a floor such that the first hat channel nests with the second hat channel, wherein the first hat channel and the second hat channel are each aligned lengthwise along a same axis, wherein the wall further includes:

a first structurally insulated panel (SIP);

a second SIP opposite the first SIP, wherein the first hat channel couples the first SIP and the second SIP along a first edge of the wall, wherein the first hat channel forms a first recess within an interior of the wall, wherein the first recess includes an opening to an exterior of the first edge of the wall, wherein the first hat channel extends lengthwise along the first edge of the wall, and wherein the first edge of the wall extends lengthwise along the floor when the wall is installed in a structure, and wherein each of the first SIP and the second SIP comprises:

a foam core;

a magnesium oxide board coupled to a first surface of the foam core; and a fiber cement board coupled to a second surface of the foam core, wherein the second surface is opposite the first surface;

a weather resistive barrier coupled to the magnesium oxide board of the first SIP; and a vertical furring channel coupled to the first SIP over the weather resistive barrier; and placing a wall having a third hat channel over a fourth hat channel coupled to a ceiling such that the third hat channel nests with the fourth hat channel, wherein the third hat channel and the fourth hat channel are each aligned lengthwise along the same axis.

15. The method of claim 14, further comprising:

coupling the second hat channel to the floor; and coupling the fourth hat channel to the ceiling.

16. The method of claim 14, further comprising coupling the first hat channel and the second hat channel with a fastener.

17. The method of claim 14, further comprising applying a fire sealant between the walls and the floor.

* * * * *